US012680223B2

(12) United States Patent
Chang et al.

(10) Patent No.: US 12,680,223 B2
(45) Date of Patent: Jul. 14, 2026

(54) DRYER AND METHOD FOR CONTROLLING SAME

(71) Applicant: SAMSUNG ELECTRONICS CO., LTD., Suwon-si (KR)

(72) Inventors: Seokmo Chang, Suwon-si (KR); Hyungwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 667 days.

(21) Appl. No.: 18/113,845

(22) Filed: Feb. 24, 2023

(65) Prior Publication Data

US 2023/0220609 A1 Jul. 13, 2023

Related U.S. Application Data

(63) Continuation of application No. PCT/KR2021/009149, filed on Jul. 16, 2021.

(30) Foreign Application Priority Data

Sep. 9, 2020 (KR) ..... 10-2020-0115220

(51) Int. Cl.
*D06F 58/50* (2020.01)
*D06F 34/05* (2020.01)
(Continued)

(52) U.S. Cl.
CPC ..... *D06F 58/50* (2020.02); *D06F 34/05* (2020.02); *D06F 34/08* (2020.02); *D06F 58/206* (2013.01);
(Continued)

(58) Field of Classification Search
CPC ..... D06F 58/50; D06F 34/08; D06F 2103/52; D06F 2105/58; D06F 34/26;
(Continued)

(56) References Cited

U.S. PATENT DOCUMENTS 6,778,868 B2 * 8/2004 Imamura ..... H04L 12/2825 68/12.02
8,547,200 B2 * 10/2013 Han ..... H04L 12/2827 340/5.1
(Continued)

FOREIGN PATENT DOCUMENTS

CN 103306116 A 9/2013
CN 106917221 A 7/2017
(Continued)

OTHER PUBLICATIONS

International Search Report, PCT/ISA/210, dated Nov. 5, 2021, in International Application No. PCT/KR2021/009149.
(Continued)

*Primary Examiner* — David J Laux
(74) *Attorney, Agent, or Firm* — STAAS & HALSEY LLP

(57) ABSTRACT

A dryer including a drum; a heat pump including a compressor, evaporator, condenser, and electronic expansion valve; a user interface; a power module to control power supply to the compressor motor and the drum motor; a duct to receive air from the drum so that the received air flows in the duct to be heated by operation of an evaporator and condenser, and to discharge the heated air to the drum; a plurality of temperature sensors to detect temperature of the heat pump, the power module, and the duct; and a controller configured to identify a factor to be controlled from among a plurality of factors that may cause incomplete drying, based on at least one of output data from the plurality of temperature sensors and opening degree data of the electronic expansion valve, and control the user interface to output a notification of the identified factor to be controlled.

13 Claims, 11 Drawing Sheets

(51) Int. Cl.

| | |
|---|---|
| ***D06F 34/08*** | (2020.01) |
| ***D06F 58/20*** | (2006.01) |
| ***D06F 58/26*** | (2006.01) |
| ***D06F 103/52*** | (2020.01) |
| ***D06F 105/58*** | (2020.01) |

(52) U.S. Cl.
CPC ..... *D06F 58/26* (2013.01); *D06F 2103/52* (2020.02); *D06F 2105/58* (2020.02)

(58) Field of Classification Search
CPC ..... D06F 2103/00; D06F 2103/32; D06F 2103/42; D06F 2103/50; D06F 2105/62
See application file for complete search history.

(56) References Cited

U.S. PATENT DOCUMENTS

| | | | | |
|---|---|---|---|---|
| 9,417,009 | B2 * | 8/2016 | Heo | F26B 23/001 |
| 9,435,587 | B2 * | 9/2016 | Lee | F26B 25/009 |
| 10,273,628 | B2 * | 4/2019 | Je | D06F 58/50 |
| 10,760,203 | B2 * | 9/2020 | Seo | D06F 58/36 |
| 10,793,996 | B2 * | 10/2020 | Seo | D06F 58/38 |
| 10,900,164 | B2 * | 1/2021 | Seok | D06F 58/48 |
| 10,962,609 | B2 * | 3/2021 | Anfiteatro | G01B 7/003 |
| 2006/0086000 | A1 * | 4/2006 | Lee | D06F 58/50 34/524 |
| 2008/0141553 | A1 * | 6/2008 | Son | D06F 58/203 34/524 |
| 2009/0071032 | A1 * | 3/2009 | Kreutzfeldt | D06F 58/44 34/526 |
| 2009/0248206 | A1 * | 10/2009 | Yoo | D06F 58/50 700/275 |
| 2013/0139402 | A1 * | 6/2013 | Hong | D06F 58/50 34/427 |
| 2016/0130743 | A1 * | 5/2016 | Wisherd | F26B 3/343 34/132 |
| 2016/0298281 | A1 * | 10/2016 | Anderson | D06F 58/20 |
| 2017/0145624 | A1 * | 5/2017 | Dulberg | D06F 58/20 |
| 2018/0016726 | A1 * | 1/2018 | Lv | F25B 1/00 |
| 2018/0080169 | A1 * | 3/2018 | Je | D06F 58/206 |
| 2018/0190093 | A1 * | 7/2018 | Krula | G08B 21/182 |
| 2018/0274166 | A1 * | 9/2018 | Xu | D06F 58/46 |
| 2019/0152497 | A1 * | 5/2019 | Murata | G01K 3/06 |
| 2019/0169783 | A1 * | 6/2019 | Seo | D06F 58/38 |

FOREIGN PATENT DOCUMENTS

| | | | |
|---|---|---|---|
| CN | 107923819 | A | 4/2018 |
| CN | 109642762 | A | 4/2019 |
| CN | 109898311 | A | 6/2019 |
| EP | 2 333 149 | A1 | 6/2011 |
| EP | 2 840 179 | A1 | 2/2015 |
| JP | 2013-94215 | | 5/2013 |
| JP | 2016-97249 | | 5/2016 |
| JP | 6038511 | | 12/2016 |
| KR | 10-0413290 | | 12/2003 |
| KR | 10-0506593 | | 8/2005 |
| KR | 10-2006-0036726 | | 5/2006 |
| KR | 10-0652782 | | 12/2006 |
| KR | 10-0751132 | | 8/2007 |
| KR | 10-0751816 | | 8/2007 |
| KR | 10-1208265 | | 12/2012 |
| KR | 10-1253625 | | 4/2013 |
| KR | 10-1319873 | | 10/2013 |
| KR | 10-1467770 | | 12/2014 |
| KR | 10-1552619 | | 9/2015 |
| KR | 10-2017-0068820 | | 6/2017 |
| KR | 10-1752415 | | 6/2017 |
| KR | 10-2018-0032114 | | 3/2018 |
| KR | 10-2018-0041644 | | 4/2018 |
| KR | 10-2018-0110791 | | 10/2018 |
| KR | 10-2019-0065149 | | 6/2019 |
| KR | 10-2012455 | | 8/2019 |
| KR | 10-2019-0101859 | | 9/2019 |
| WO | WO 2014/187494 | A1 | 11/2014 |

OTHER PUBLICATIONS

Chinese Office Action dated Jul. 18, 2025 for Chinese Application No. 202180054783.X.

European Office Action issued under Rule 71(3) EPC dated Oct. 16, 2025 for European Application No. 218669802.

Extended European Search Report dated Oct. 30, 2023 in European PatentApplication No. 21866980.2.

European Office Action dated Oct. 16, 2025 for European Application No. 21866980.2.

Korean Office Action dated Jan. 27, 2026 for Korean Application No. 10-2020-0115220.

* cited by examiner

DRYER AND METHOD FOR CONTROLLING SAME

CROSS-REFERENCE TO RELATED APPLICATIONS

This application is a continuation application under 35 U.S.C. § 111(a) of international Application No. PCT/KR2021/009149, filed on Jul. 16, 2021, which claims priority to Korean Patent Application No. 10-2020-0115220, filed on Sep. 9, 2020, the disclosures of which are incorporated by reference herein in their entireties.

BACKGROUND

1. Field

The present disclosure relates to a dryer for drying laundry such as clothes and detecting incomplete drying in advance.

2. Description of the Related Art

A dryer is a laundry treating apparatus for drying laundry, such as clothes, towels, bedding, etc., by supplying hot air to the inside of the drum accommodating the laundry while rotating the drum.

A drying operation of laundry may be performed for a preset time or for a time set according to an initial weight of the laundry. Or, a finish time may depend on a measured dryness.

However, as the number of uses increases, incomplete drying occurs due to termination of a drying operation even though drying is not yet complete or a long operation time of a drying operation. Factors that cause such incomplete drying include filer clogging, duct clogging, refrigerant insufficiency, a heater failure, an operation interruption caused by circuit overheating, etc.

As such, although there are various factors that cause incomplete drying, it is difficult to recognize incomplete drying in advance and specify a cause of the incomplete drying.

SUMMARY

Aspects of embodiments of the disclosure will be set forth in part in the description which follows and, in part, will be apparent from the description, or may be learned by practice of the presented embodiments.

According to an embodiment of the disclosure, a dryer may include a drum; a drum motor connected to the drum; a heat pump including a compressor including a compressor motor, an evaporator, a condenser, and an electronic expansion valve; a user interface; a power module configured to control power supply to the compressor motor and the drum motor; a duct accommodating the evaporator and the condenser, and configured to receive air from the drum so that the received air flows in the duct to be heated by operation of the evaporator and the condenser, and discharge the heated air to the drum; a plurality of temperature sensors configured to detect temperature of each of the heat pump, the power module, and the duct; and a controller configured to identify a factor to be controlled from among a plurality of factors that may cause incomplete drying, based on at least one of output data from the plurality of temperature sensors and opening degree data of the electronic expansion valve, and control the user interface to output a notification of the identified factor to be controlled.

According to an embodiment of the disclosure, the controller is configured to identify the factor to be controlled in a case in which an operation time of a drying operation becomes longer by a preset time or longer than an expected time.

According to an embodiment of the disclosure, the dryer further includes a storage device, and the controller is configured to control the storage device to store, whenever a drying operation is performed, the output data from the plurality of temperature sensors and the opening degree data of the electronic expansion valve, and identify the factor to be controlled while the drying operation is performed by comparing at least one of the output data from the plurality of temperature sensors and the opening degree data of the electronic expansion valve of the heat pump with stored data.

According to an embodiment of the disclosure, the controller is configured to identify clogging of the duct as the factor to be controlled in a case in which a number of times by which at least one of temperature of the duct and temperature of the compressor deviates from a corresponding preset temperature range increases in comparison with the stored output data from the plurality of temperature sensors.

According to an embodiment of the disclosure, the dryer further includes a cooling device to cool the power module, and the controller is configured to identify a failure of the cooling device as the factor to be controlled in a case in which a number of times by which temperature of the power module deviates from a preset temperature range increases in comparison with the stored output data from the plurality of temperature sensors.

According to an embodiment of the disclosure, the controller is configured to identify refrigerant insufficiency of the heat pump as the factor to be controlled in a case in which the opening degree of the electronic expansion valve deviates from an opening degree range of the stored opening degree data of the electronic expansion valve during a drying operation.

According to an embodiment of the disclosure, the controller is configured to identify refrigerant insufficiency of the heat pump as the factor to be controlled in a case in which temperature of a refrigerant discharged from the compressor deviates from a temperature range of the stored output data from the plurality of temperature sensors during a drying operation.

According to an embodiment of the disclosure, the dryer further includes a heater provided in the duct and configured to heat the received air in the duct, and the controller is configured to identify a failure of the heater as the factor to be controlled in a case in which a number of times by which temperature of the heater deviates from a preset temperature range increases in comparison with the stored output data from the plurality of temperature sensors.

According to an embodiment of the disclosure, the dryer further includes a communicator, and the controller is configured to control the communicator to transmit the notification of the factor to be controlled to an external electronic device.

According to an embodiment of the disclosure, the controller is configured to control the user interface to output content of an action corresponding to the factor to be controlled.

According to an embodiment of the disclosure, a method of controlling a dryer, the dryer including a drum, a heat pump, a user interface, a power module configured to control power supply to a compressor motor of the heat pump and a drum motor connected with the drum, and a duct accommodating an evaporator and a condenser of the heat pump and configured to receive air from the drum so that the received air flows in the duct to be heated by operation of the evaporator and the condenser, and discharge the heated air to the drum, may include identifying a factor to be controlled from among a plurality of factors that may cause incomplete drying, based on at least one of output data from a plurality of temperature sensors configured to detect temperature of each of the heat pump, the power module, and the duct, and opening degree data of an electronic expansion valve provided in the heat pump; and controlling the user interface to output a notification of the identified factor to be controlled.

According to an embodiment of the disclosure, the identifying of the factor to be controlled includes identifying the factor to be controlled in a case in which an operation time of a drying operation becomes longer by a preset time or longer than an expected time.

According to an embodiment of the disclosure, the dryer further includes a storage device, and the identifying of the factor to be controlled includes controlling the storage device to store, whenever a drying operation is performed, the output data from the plurality of temperature sensors and the opening degree data of the electronic expansion valve, and identifying the factor to be controlled while the drying operation is performed by comparing at least one of the output data from the plurality of temperature sensors and the opening degree data of the electronic expansion valve of the heat pump with stored data.

According to an embodiment of the disclosure, the identifying of the factor to be controlled includes identifying clogging of the duct as the factor to be controlled in a case in which a number of times by which at least one of temperature of the duct and temperature of a compressor of the heat pump deviates from a corresponding preset temperature range increases in comparison with the stored output data from the plurality of temperature sensors.

According to an embodiment of the disclosure, the dryer further includes a cooling device to cool the power module, and the identifying of the factor to be controlled includes identifying a failure of the cooling device as the factor to be controlled in a case in which a number of times by which temperature of the power module deviates from a preset temperature range increases in comparison with the stored output data from the plurality of temperature sensors.

DETAILED DESCRIPTION

Figure 1:
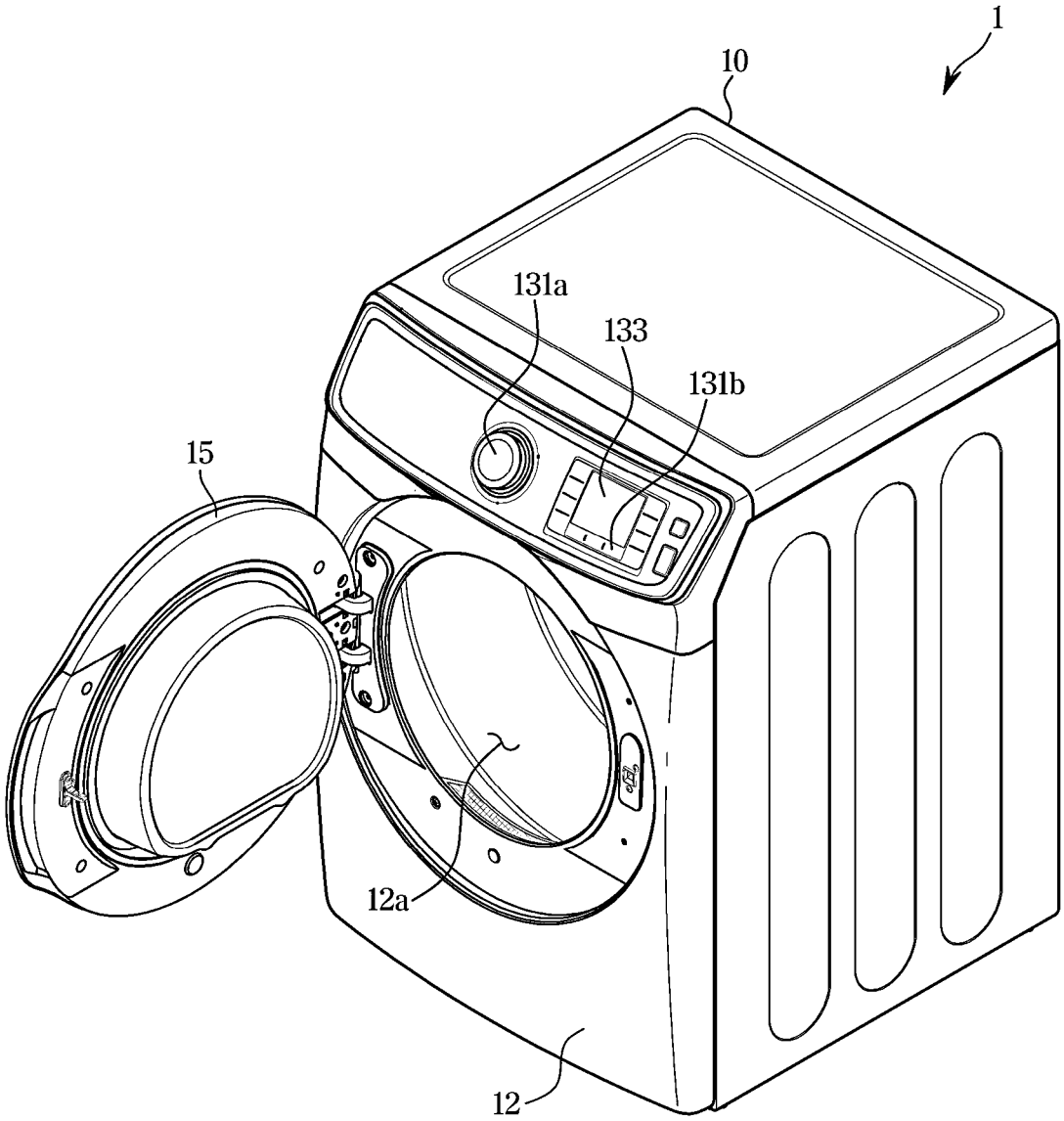
FIG. 1 shows an appearance of a dryer according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Through this specification, it will be understood that when a certain part is referred to as being "connected" to another part, it can be directly or indirectly connected to the other part. When a part is indirectly connected to another part, it may be connected to the other part through a wireless communication network.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Reference numerals used in operations are provided to identify the operations, without describing the order of the operations, and the operations can be executed in a different order from the stated order unless a specific order is definitely specified in the context.

Terminology such as "at least one of A and B", as used herein, includes any of the following: A, B, A and B.

Embodiments of the disclosure may provide a dryer for facilitating maintenance and preventing incomplete drying by detecting a plurality of factors that may cause incomplete drying whenever a drying operation is performed and notifying a factor actually causing incomplete drying as a factor to be controlled.

A dryer according to embodiments of the disclosure may facilitate maintenance and prevent incomplete drying by detecting a plurality of factors that may cause incomplete drying whenever a drying operation is performed and notifying a factor actually causing incomplete drying as a factor to be controlled.

Hereinafter, an embodiment of the disclosure will be described in detail with reference to the accompanying drawings.

Figure 2:
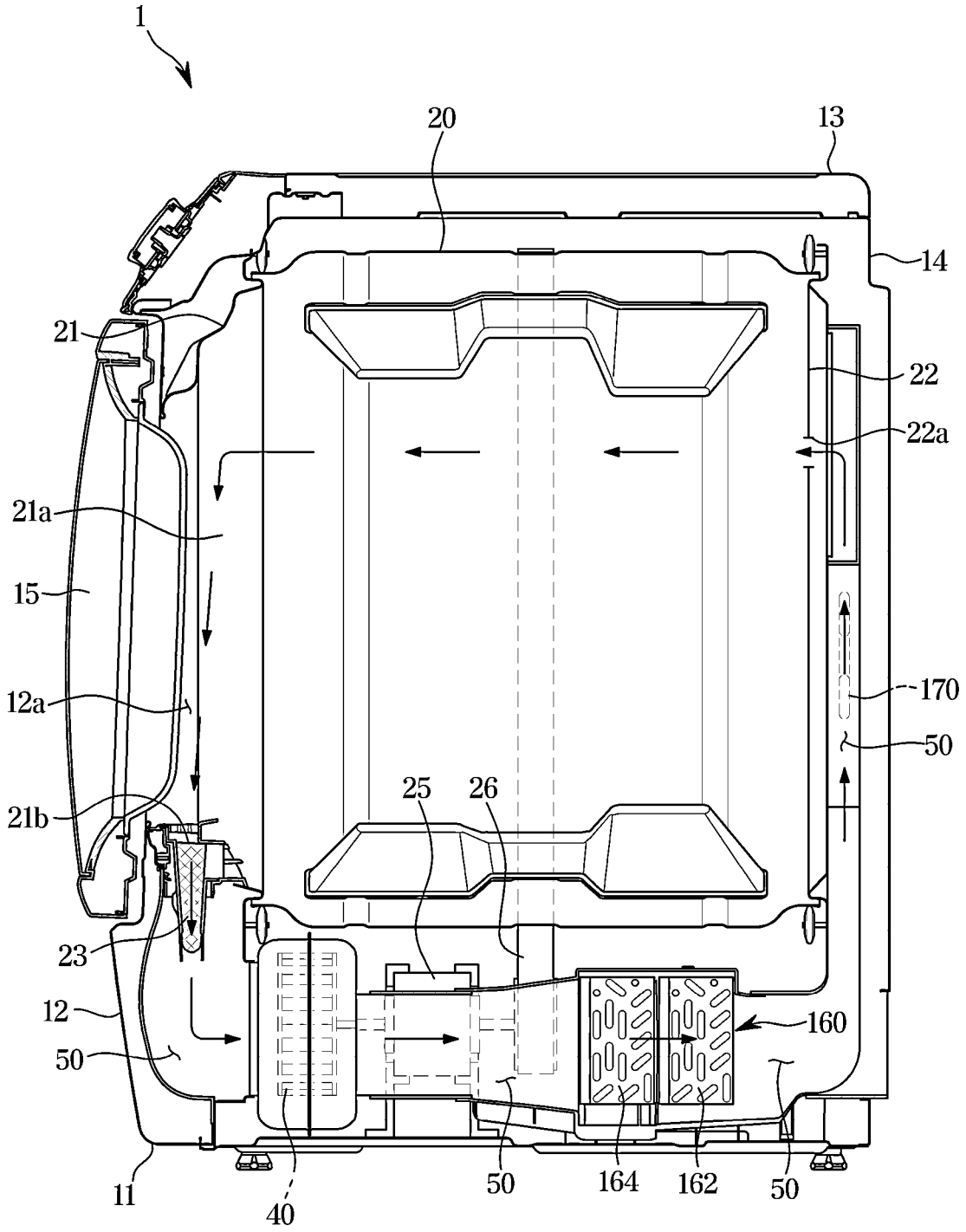
FIG. 2 is a side cross-sectional view of a dryer according to an embodiment of the disclosure.

FIG. 1 shows an appearance of a dryer according to an embodiment of the disclosure, and FIG. 2 is a side cross-sectional view of a dryer according to an embodiment of the disclosure.

Referring to FIGS. 1 and 2, a dryer 1 according to an embodiment may include a main body 10 forming an appearance, and a drum 20 rotatably installed inside the main body 10 and accommodating laundry.

The main body 10 may include a base plate 11, a front cover 12, a top cover 13, and a side/rear cover 14.

In the front cover 12, an opening 12*a* may be provided, and the opening 12*a* may be opened or closed by a door 15 rotatably installed on the front cover 12. The drum 20, which is in a shape of a cylinder having an open front side, may also be opened or closed by the door 15.

On an upper end of the front cover 12, inputters 131*a* and 131*b* for receiving a user's control command and a display 133 for displaying various information related to operations of the dryer 1 or guiding a user's input may be positioned.

The inputters 131*a* and 131*b* may be provided in a form of a jog shuttle or a dial to enable a user to input a control command by holding the inputter 131*a* and turning or pressing the inputter 131*a*, or the inputters 131*a* and 131*b* may be provided in a form of a touch pad or a button to enable a user to input a control command by touching or pressing the inputter 131*b*.

The display 133 may be implemented by various display panels, such as LCD, LED, OLED, QLED, etc., or may be implemented as a touch screen by including a touch pad on a front surface.

On a front surface of the drum 20, a front panel 21 forming an inlet 21*a* may be positioned, and laundry may be put into the drum 20 through the inlet 21*a*. Also, a rear surface of the drum 20 may be closed by a rear panel 22 including an outlet 22*a* through which hot and dry air is discharged.

In the front panel 21 of the drum 20, an outlet 21*b* through which air used to dry laundry is discharged may be provided, and a filter 23 for collecting foreign materials generated from laundry may be installed in the outlet 21*b*.

That is, air discharged to the drum 20 through the outlet 22*a* may be used to dry laundry, and then enter a duct 50 from the drum 20 through the outlet 21*b*. The air used to dry laundry may enter the duct 50 to become hot and dry air through a heat pump 160, and the hot and dry air may be again discharged to the drum 20 through the outlet 22*a*.

Also, at least one protruding lifter may be formed on an inner wall of the drum 20 to assist tumbling of laundry.

The drum 20 may rotate by a driving force provided from a drum motor 25. The drum 20 may be connected with the drum motor 25 by a belt 26, and the belt 26 may transfer a driving force provided from the drum motor 25 to the drum 20.

The dryer 1 may include a fan 40 for circulating inside air of the drum 20. The fan 40 may suck air from inside of the drum 20 and discharge the air to the duct 50. By the fan 40, inside air of the drum 20 may circulate through the drum 20 and the duct 50. At this time, the fan 40 may receive a driving force from the drum motor 25 or from a motor provided independently from the drum motor 25. A fan motor for providing a driving force to the fan 40 may be the drum motor 25, or may be provided independently from the drum motor 25.

On the duct 50 through which inside air of the drum 20 circulates, the heat pump 160 may be provided. The heat pump 160 may include a compressor (not shown), a condenser 162, an evaporator 164, and an electronic expansion valve (EEV) (not shown).

The compressor may compress a gaseous refrigerant to a high-temperature and high-pressure state, and discharge the compressed high-temperature, high-pressure gaseous refrigerant. For example, the compressor may compress a refrigerant through a reciprocation motion of a piston or a rotary motion of a rotor according to a driving force from a compressor motor. The discharged refrigerant may be transferred to the condenser 162.

The condenser 162 may emit heat to surroundings while condensing the compressed gaseous refrigerant into a liquid. The condenser 162 may be provided on the duct 50, and heat air through heat generated in the process of condensing the refrigerant. The heated air may be supplied to the drum 20. The liquid refrigerant condensed in the condenser 162 may be transferred to the electronic expansion valve.

The electronic expansion valve may expand the high-temperature, high-pressure liquid refrigerant condensed in the condenser 162 into a low-pressure liquid refrigerant. More specifically, the electronic expansion valve may change an opening degree by a capillary tube and an electrical signal for adjusting pressure of a liquid refrigerant.

The evaporator 164 may evaporate the liquid refrigerant expanded by the electronic expansion valve. As a result, the evaporator may return a low-temperature, low-pressure gaseous refrigerant to the compressor.

The evaporator 164 may absorb heat from surroundings through an evaporation process of changing a low-pressure liquid refrigerant to a gaseous refrigerant. The evaporator 164 may be provided on the duct 50, and cool air passing through the evaporator 164 in the evaporation process. Surrounding air may be cooled by the evaporator 164, and as temperature of the surrounding air is lowered to less than a dew point, the surrounding air of the evaporator 164 may be condensed. Water condensed in the evaporator 164 may be collected in a water case provided in a lower portion of the evaporator 164. The water collected in the water case may move to a separate storage space or be drained to outside of the dryer 1.

According to the condensation around the evaporator 164, absolute humidity of air passing through the evaporator 164 may be lowered. In other words, an amount of water vapor included in air passing through the evaporator 164 may be reduced. The dryer 1 may reduce an amount of water vapor included in inside air of the drum 20 by using condensation around the evaporator 164, and dry laundry.

The evaporator 164 may be positioned upstream of the condenser 62 on a flow of air by the fan 40. Air circulating by the fan 40 may be dried (condensation of water vapor) by the evaporator 164 while passing through the evaporator 164, and then, heated by the condenser 162 while passing through the condenser 162.

Meanwhile, a heater 170 that assists the condenser 162 to heat air may be provided in the duct 50. The heater 170 may be positioned downstream of the condenser 162 on the flow of air by the fan 40.

For example, air heated by the condenser 162 of the heat pump 160 may be additionally heated by the heater 170, and accordingly, inside air of the duct 50 may be sufficiently heated.

Inside temperature of the drum 20 may rise more rapidly by the heater 170 that assists the condenser 162, which reduces a time consumed for drying laundry.

A drying operation of laundry may be performed for a preset time or for a time set according to an initial weight of the laundry. Or, a finish time may depend on a measured dryness.

However, as a number of uses increases, incomplete drying occurs due to termination of a drying operation even though drying is not yet complete or a long operation time of a drying operation. Factors that cause such incomplete drying may include filer clogging, duct clogging, refrigerant insufficiency, a heater failure, etc.

An operation of a dryer for detecting a plurality of factors that may cause incomplete drying and notifying a factor actually causing incomplete drying as a factor to be controlled will be described in more detail.

Figure 3:
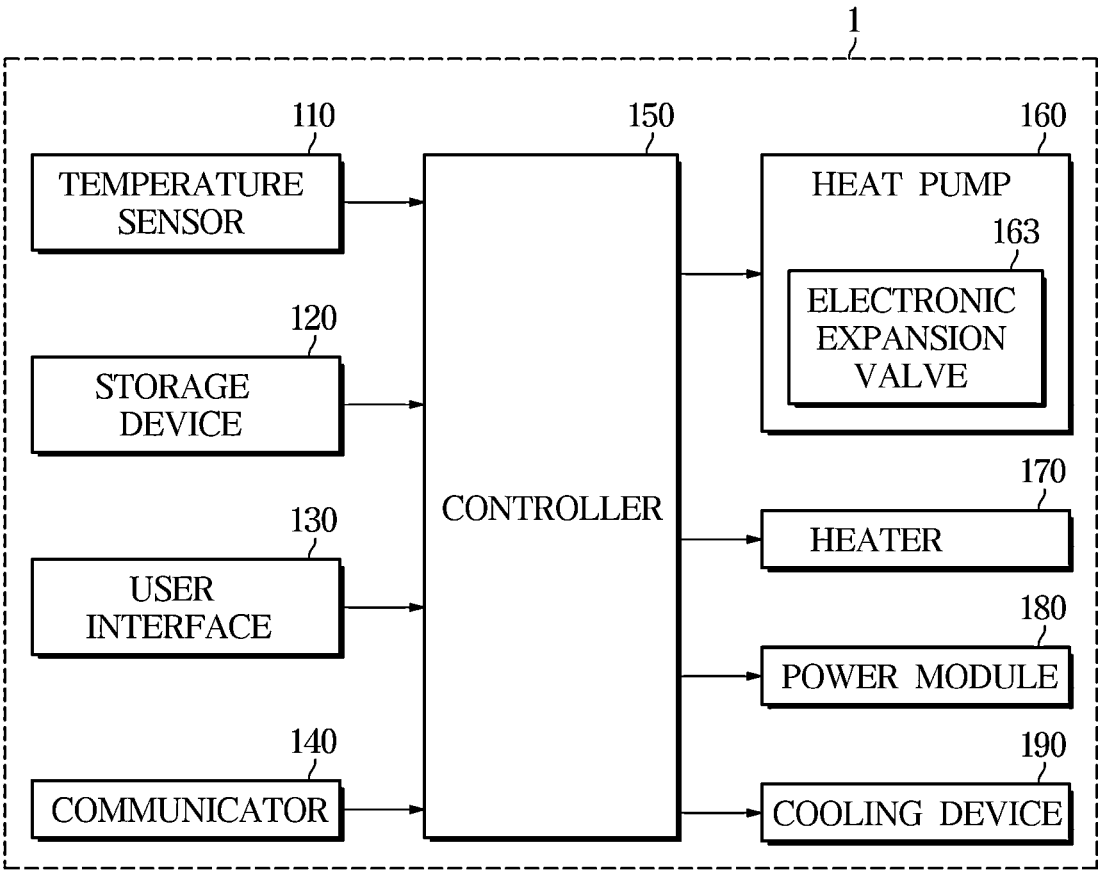
FIG. 3 is a control block diagram of a dryer according to an embodiment of the disclosure.
Figure 4:
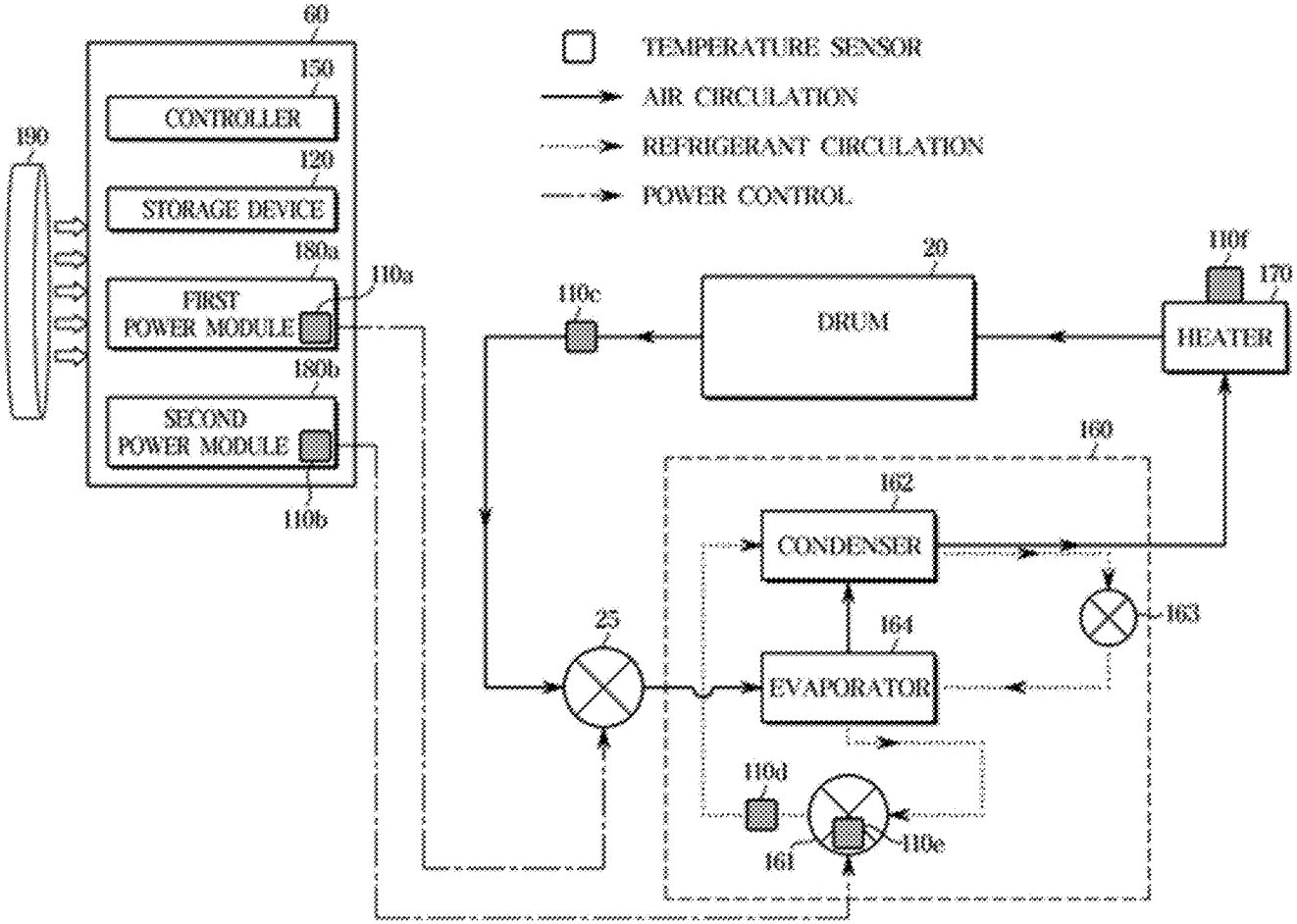
FIG. 4 is a view for describing a case of detecting incomplete drying in a dryer according to an embodiment of the disclosure.

FIG. 3 is a control block diagram of the dryer 1 according to an embodiment, and FIG. 4 is a view for describing a case of detecting incomplete drying in the dryer 1 according to an embodiment.

Referring to FIG. 3, the dryer 1 according to an embodiment may include a plurality of temperature sensors 110 provided at a plurality of locations inside the dryer 1 to detect temperature, a storage device 120 that stores various information such as output data from the plurality of temperature sensors 110, a user interface 130 for displaying information about a factor to be controlled among a plurality of factors that may cause incomplete drying, a communicator 140 for communicating with an external electronic device (not shown), a controller 150 for identifying a factor to be controlled, the heat pump 160 for providing hot air by performing heat exchange and including an electronic expansion valve 163, the heater 170 provided on the duct 50 to heat air, a power module 180 for controlling power supply to the drum motor 25 and the compressor motor of the heat pump 160, and a cooling device 190 for cooling a printed circuit board (PCB) on which the storage device 120, the controller 150, and the power module 180 are provided.

At least one component may be added or omitted in correspondence to performances of components of the dryer 1 shown in FIG. 3. Also, it will be easily understood to one of ordinary skill in the art that relative positions of the components may be changed in correspondence to the performance or structure of system.

Referring to FIG. 4, the storage device 120, the controller 150, and the power module 180 may be provided on a single printed circuit board 60. However, according to embodiments, the storage device 120, the controller 150, and the power module 180 may be distributed on a plurality of printed circuit boards.

In this case, the power module 180 may correspond to intelligent power modules (IPM) that control power supply for rotating a motor. That is, the power module 180 may correspond to a 3-phase inverter, and supply 3-phase current to the motor. In this case, the power module 180 may include a first power module 180*a* for controlling power supply to the drum motor 25, and a second power module 180*b* for controlling power supply to a compressor 161 (compressor motor) of the heat pump 160.

The cooling device 190 may include a cooling fan and a motor for supplying a driving force to the cooling fan, and be provided on one side of the printed circuit board 60 to supply a flow of air to the printed circuit board 60, thereby cooling the printed circuit board 60. A type of the cooling device 190 is not limited to a cooling fan, and according to embodiments, the cooling device 190 may be provided as a heat exchanger. The type of the cooling device 190 is not limited.

The temperature sensors 110 according to an embodiment may be a plurality of sensors, and the plurality of temperature sensors 110 may be provided at different locations to detect temperature at the respective locations.

For example, the temperature sensors 110 may include, as shown in FIG. 4, a first temperature sensor 110*a* provided on one side of the printed circuit board 60 to detect temperature of the first power module 180*a*, and a second temperature sensor 110*b* provided on one side of the printed circuit board 60 to detect temperature of the second power module 180*b*.

Also, the temperature sensors 110 may include a third temperature sensor 110*c* provided on the duct 50 around the outlet 21*b* to detect temperature of the duct 50, and a fourth temperature sensor 110*d* provided on a refrigerant pipe connected with the compressor 161 of the heat pump 160 to detect temperature of a refrigerant discharged from the compressor 161.

Also, the temperature sensors 110 may include a fifth temperature sensor 110*e* provided on the heat pump 160 to detect temperature of the heat pump 160. For example, the fifth temperature sensor 110*e* may be provided on one side of the compressor 161 to detect temperature of the compressor 161.

Also, according to embodiments, the temperature sensors 110 may include a sixth temperature sensor 110*f* provided on one side of the heater 170 to detect temperature of the heater 170.

As such, the plurality of temperature sensors 110 may be provided at a plurality of locations inside the dryer 1 to detect temperature of the components of the dryer 1. The locations and number of the temperature sensors 110 are not limited to the above-described example, and various numbers of temperature sensors 110 may be provided at various locations, according to embodiments.

The storage device 120 according to an embodiment may store various information required to control the dryer 1. For this, the storage device 120 may be provided as a known type of storage medium.

More specifically, the storage device 120 may store data that is used to detect incomplete drying.

For example, the storage device 120 may store output data from the temperature sensors 110 and opening degree data of the electronic expansion valve 163. That is, whenever a drying operation is performed, output data from the plurality of temperature sensors 110 may be stored in the storage device 120, and whenever a drying operation is performed, opening degree data of the electronic expansion valve 163 may be stored in the storage device 120.

The user interface 130 according to an embodiment may receive an input for a drying mode from a user. Also, the user interface 130 according to an embodiment may visually or acoustically notify information about a factor to be controlled, causing incomplete drying, and notify content of an action corresponding to the factor to be controlled.

For this, the user interface 130 may include the inputters 131*a* and 131*b* and the display 133. However, according to embodiments, the user interface 130 may further include a speaker.

For example, the user interface 130 may display a factor to be controlled, which is predicted to actually cause incomplete drying, through the display 133. Also, the user interface 130 may display content of an action corresponding to the factor to be controlled.

Thereby, the user may recognize a factor that may cause incomplete drying from among the plurality of factors, and prevent generation of incomplete drying by performing an action for the factor to be controlled before incomplete drying occurs.

The communicator 140 according to an embodiment may communicate with an external electronic device. For this, the communicator 140 may be configured with a wired communication module or a wireless communication module, and connected with a network to transmit data to the external electronic device. In this case, the external electronic device may correspond to a server of a manufacturing company of the dryer 1 or a user terminal (for example, a smart phone) of a user who uses the dryer 1.

For example, the communicator 140 may transmit information about a factor to be controlled, which is predicted to actually cause incomplete drying, content of an action corresponding to the factor to be controlled, etc., to the external electronic device.

Thereby, the user may recognize, even when he/she is not located around the dryer 1, a factor that may cause incomplete drying from among the plurality of factors, and prevent generation of incomplete drying by performing an action for the factor to be controlled before incomplete drying occurs.

The controller 150 according to an embodiment may identify a factor to be controlled from among the plurality of factors that cause incomplete drying based on at least one of output data from the plurality of temperature sensors 110 or opening degree data of the electronic expansion valve 163 provided in the heat pump 160. The factor to be controlled may be a factor that is predicted to actually cause incomplete drying and correspond to a factor on which an action for preventing incomplete drying needs to be performed.

For example, the plurality of factors that may cause incomplete drying may include clogging of the duct 50, a failure of the cooling device 190, refrigerant insufficiency of the heat pump 160, a failure of the heater 170, etc.

At this time, the controller 150 may obtain output data from the temperature sensors 110, and obtain opening degree data of the electronic expansion valve 163 based on an electronic signal for changing an opening degree of the electronic expansion valve 163.

According to embodiments, the controller 150 may start an operation for identifying a factor to be controlled upon a start of a drying operation. That is, the controller 150 may collect and analyze, upon a start of a drying operation, output data from the plurality of temperature sensors 110 or opening degree data of the electronic expansion valve 163 provided in the heat pump 160 to identify a factor to be controlled.

Also, according to embodiments, the controller 150 may start an operation for identifying a factor to be controlled in a case in which an operation time of a drying operation exceeds an expected time. For example, the controller 150 may start an operation for identifying a factor to be controlled in a case in which an operation time of a drying operation becomes longer by a preset time or more than the expected time.

The controller 150 may set an expected time for a drying operation based on a drying mode set through the inputters 131*a* and 131*b*, a weight of laundry measured by a weight sensor (not shown), etc. Also, the controller 150 may set a termination time of a drying operation by measuring a dryness of laundry based on a temperature difference, etc., between air entering an electrode sensor (not shown) or the drum 20 and air discharged from the electrode sensor or the drum 20. The operation of setting the expected time for the drying operation and the operation of setting the termination time of the drying operation may be performed as known operations, instead of the above-described examples.

In the case in which the operation time of the drying operation becomes longer than the expected time, the controller 150 may start an operation for identifying a factor to be controlled, that is causing incomplete drying. That is, in the case in which the operation time becomes longer than the expected time, the dryer 1 may start an operation for identifying a factor to be controlled under an assumption that there is a factor causing incomplete drying.

For example, in a case in which the compressor 161 is interrupted temporarily as a protection operation for the compressor 161 or the heater 170 is interrupted temporarily as a protection operation for the heater 170, an operation time of a drying operation may be lengthened. Also, in a case in which heat exchange performance deteriorates due to refrigerant insufficiency of the heat pump 160 or the power module 180 is interrupted temporarily due to a failure of the cooling device 190, an operation time of a drying operation may be lengthened.

The controller 150 according to an embodiment may control the storage device 120 to store output data from the plurality of temperature sensors 110 and opening degree data of the electronic expansion valve 163 whenever a drying operation is performed.

Also, the controller 150 according to an embodiment may compare, while a drying operation is performed, at least one of output data from the plurality of temperature sensors 110 or opening degree data of the electronic expansion valve 163 of the heat pump 160 with stored data to identify a factor to be controlled.

That is, the controller 150 may compare at least one of output data from the temperature sensors 110 or opening degree data of the electronic expansion valve 163 in a drying operation being currently performed, with data in a previous drying operation, stored in the storage device 120, to identify a factor to be controlled in the current drying operation.

More specifically, in a case in which a number of times by which at least one of temperature of the duct 50 or temperature of the compressor 161 deviates from a preset temperature range increases in comparison with temperature of data stored in the storage device 120, the controller 150 may identify clogging of the duct 50 among the plurality of factors as a factor to be controlled.

Also, in a case in which a number of times by which temperature of the power module 180 deviates from the preset temperature range increases in comparison with temperature of data stored in the storage device 120, the controller 150 may identify a failure of the cooling device 190 among the plurality of factors as a factor to be controlled.

Also, in a case in which an opening degree of the electronic expansion valve 163 deviates from an opening degree range of stored opening degree data during a drying operation, the controller 150 may identify refrigerant insufficiency of the heat pump 160 among the plurality of factors as a factor to be controlled.

Also, in a case in which temperature of a refrigerant discharged from the compressor 161 deviates from a temperature range of stored data during a drying operation, the controller 150 may identify refrigerant insufficiency of the heat pump 160 among the plurality of factors as a factor to be controlled.

Also, in a case in which a number of times by which temperature of the heater 170 deviates from a preset temperature range increases in comparison with temperature of stored data, the controller 150 may identify a failure of the heater 170 as a factor to be controlled.

An operation of identifying a factor to be controlled among the plurality of factors in the controller 150 will be described in detail below.

The controller 150 according to an embodiment may control, after the factor to be controlled is identified, the user interface 130 to output a notification for the factor to be controlled. For example, the controller 150 may control the display 133 of the user interface 130 to display the factor to be controlled, or the speaker of the user interface 130 to output the factor to be controlled as a voice message.

Also, according to embodiments, the controller 150 may control the user interface 130 to output content of an action corresponding to the factor to be controlled. For example, the controller 150 may control the display 133 of the user interface 130 to display the content of the action corresponding to the factor to be controlled, or the speaker of the user interface 130 to output the content of the action corresponding to the factor to be controlled as a voice message.

Thereby, a user may identify a factor that may cause incomplete drying among the plurality of factors, and prevent generation of incomplete drying by performing an action for the factor to be controlled before incomplete drying occurs.

The controller 150 according to an embodiment may control, after the factor to be controlled is identified, the communicator 140 to transmit a notification for the factor to be controlled to an external electronic device. Also, the controller 150 may control the communicator 140 to transmit content of an action corresponding to the factor to be controlled to the external electronic device.

Thereby, the user may recognize, even when he/she is not located around the dryer 1, a factor that may cause incomplete drying from among the plurality of factors, and prevent generation of incomplete drying by performing an action for the factor to be controlled before incomplete drying occurs.

The controller 150 may include at least one memory that stores a program for performing the above-described operations and operations that will be described below, and at least one processor that executes the stored program.

The heat pump 160 according to an embodiment may be provided on the duct 50 and perform heat exchange with air passing through the duct 50 during a drying operation. For this, the heat pump 160 may include the compressor 161, the condenser 162, the electronic expansion valve 163, and the evaporator 164.

A refrigerant may be, as shown in FIG. 4, discharged from the compressor 161, pass through the condenser 162, the electronic expansion valve 163, and the evaporator 164, and then again enter the compressor 161.

The compressor 161 may drive the compressor motor according to a control signal from the second power module 180*b* to compress the refrigerant, and the compressed refrigerant may be transferred to the condenser 162 through a refrigerant pipe.

At this time, the compressor 161 may stop according to a protection operation upon an increase in temperature of the compressor 161 or an increase in temperature of the second power module 180*b*. More specifically, in a case in which temperature of the compressor 161 reaches a preset temperature, the compressor 161 may be interrupted according to a control by the controller 150. Also, in a case in which temperature of the second power module 180*b* reaches a preset temperature, the second power module 180*b* may be interrupted according to a control by the controller 150, and accordingly, the compressor 161 may also be interrupted.

That is, the compressor 161 may stop compressing as a protection operation according to a control by the controller 150 to cool the compressor 161 or the second power module 180*b*, and then, the compressor 161 may resume compressing.

At this time, temperature of the compressor 161 may rise by an effect of a rise of inside temperature, which is generated by non-smooth circulation of air due to clogging of the duct 50. Also, temperature of the second power module 180*b* may rise due to a failure of the cooling device 190.

As such, in a case in which the compressor 161 is interrupted due to a rise of temperature of the compressor 161 or the second power module 180*b*, an operation time of a drying operation may be lengthened, and incomplete drying may occur.

Also, due to refrigerant insufficiency of the heat pump 160, heat exchange performance of the heat pump 160 may deteriorate, and accordingly, temperature of a refrigerant discharged from the compressor 161 may be lowered.

Also, according to refrigerant insufficiency of the heat pump 160, the electronic expansion valve 163 may increase an opening degree depending on a control signal from the controller 150. That is, in a case in which a refrigerant amount of the heat pump 160 is reduced due to refrigerant leakage, heat exchange performance of the heat pump 160 may deteriorate, and the controller 150 may control the electronic expansion valve 163 to increase an opening degree.

As such, as a result of a reduction of a refrigerant amount of the heat pump 160, heat exchange performance of the heat pump 160 may deteriorate, and incomplete drying may occur.

The heater 170 according to an embodiment may heat air that is discharged to the drum 20 during a drying operation. For this, the heater 170 may be provided on the duct 50, and the heater 170 may be positioned downstream of the condenser 162 on a flow of air by the fan 40.

Air may flow by the fan 40 that rotates according to an operation of the drum motor 25, and, as shown in FIG. 4, air may be discharged from the drum 20 and enter the duct 50. The air may pass through the evaporator 164, the condenser 162, and the heater 170 in the duct 50 and then be again discharged to the drum 20.

The heater 170 may emit heat during a drying operation according to a control by the controller 150, and may stop emitting heat in a case in which a temperature of the heater 170 reaches a preset temperature. That is, in the case in which the temperature of the heater 170 reaches the preset temperature, the heater 170 may stop emitting heat as a protection operation according to a control by the controller 150 to be cooled, and then resume emitting heat.

As such, in a case in which the heater 170 is interrupted due to a rise in temperature of the heater 170, an operation time of the drying operation may be lengthened, and incomplete drying may occur.

The power module 180 according to an embodiment may control power supply to the drum motor 25 and the compressor motor of the compressor 161 during a drying operation, according to a control by the controller 150. That is, the power module 180 may correspond to a 3-phase inverter, and supply 3-phase current to the motor.

The power module 180 may include the first power module 180*a* for controlling power supply to the drum motor 25, and the second power module 180*b* for controlling power supply to the motor of the compressor 161. However, according to embodiments, in a case in which a fan motor for transferring a driving force to the fan 40 is provided in addition to the drum motor 25, a power module for controlling power supply to the fan motor may also be provided.

The power module 180 may emit heat by controlling power that is supplied to the motor, and the cooling device 190 may be provided on one side of the printed circuit board 60 on which the power module 180 is mounted to cool the power module 180.

In this case, upon a failure of the cooling device 190, the power module 180 may emit heat up to a preset temperature or more as a drying operation is progressed, and a power control operation of the power module 180 may be interrupted as a protection operation. That is, upon emitting of heat up to the preset temperature or more, the power module 180 may interrupt a power control operation as a protection operation according to a control by the controller 150 to be cooled, and then resume a power control operation.

As such, in the case in which the power module 180 is interrupted due to a rise in temperature of the power module 180, the compressor 161 may also be interrupted, which may result in an operation time increase of a drying operation and incomplete drying.

Also, in the case in which the power module 180 is interrupted, the fan 40 may also be interrupted, which may result in non-smooth circulation of air in the duct 50. In this case, the compressor 161 may be interrupted due to a rise in temperature of the compressor 161, or the heater 180 may be interrupted due to a rise in temperature of the heater 180, which may result in a long operation time of a drying operation and incomplete drying.

The cooling device 190 according to an embodiment may cool the printed circuit board 60 on which the storage device 120, the controller 150, and the power module 180 are mounted, during a drying operation, according to a control by the controller 150.

In this case, upon a failure of the cooling device 190, temperature of the power module 180 may become higher than in a normal state, which may result in a long operation time of a drying operation by a protection operation for the power module 180 and incomplete drying. In other words, as a protection operation for the power module 180 against overheating of the printed circuit board 60, the power module 180 may stop, and accordingly, an operation time of a drying operation may be lengthened.

So far, a control on the components of the dryer 1 has been described in detail. Hereinafter, an operation of detecting a factor that may cause incomplete drying and notifying the factor in the dryer 1 will be described in more detail.

Figure 5:
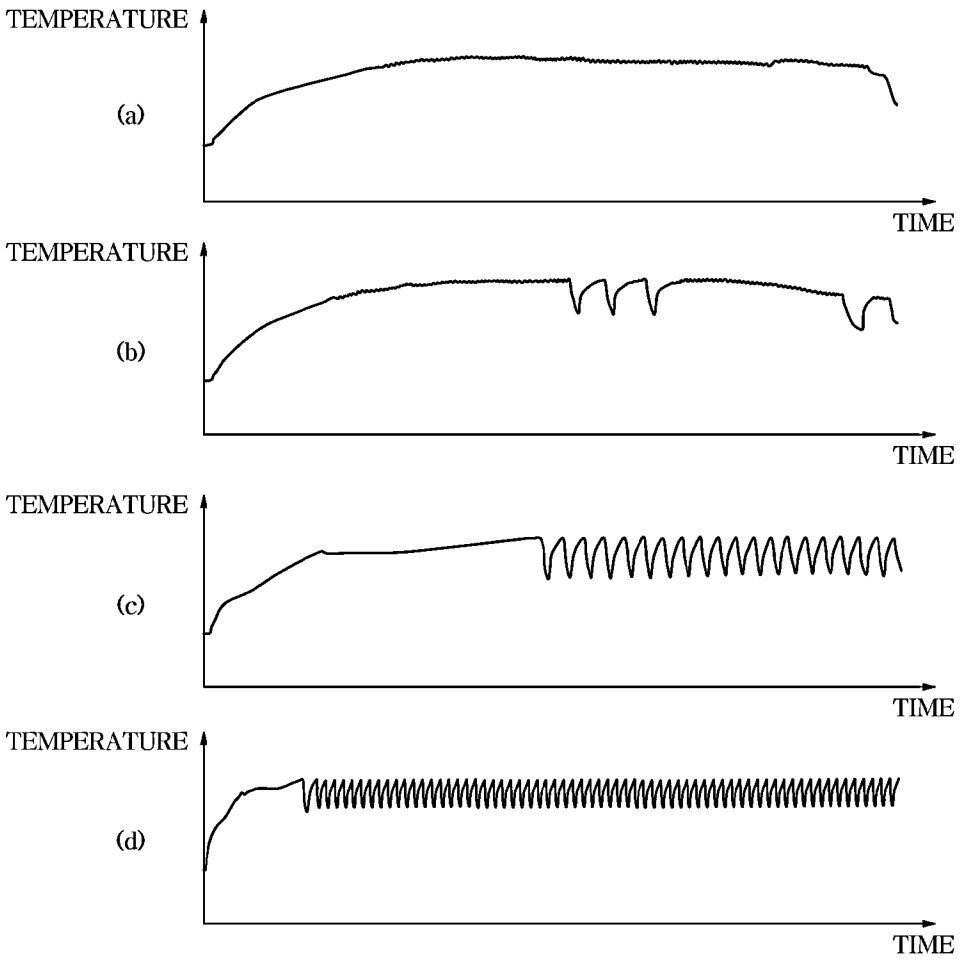
FIG. 5 illustrates graphs showing operations of a compressor, caused by an increase in temperature of the compressor due to duct clogging in a dryer according to an embodiment of the disclosure.
Figure 6:
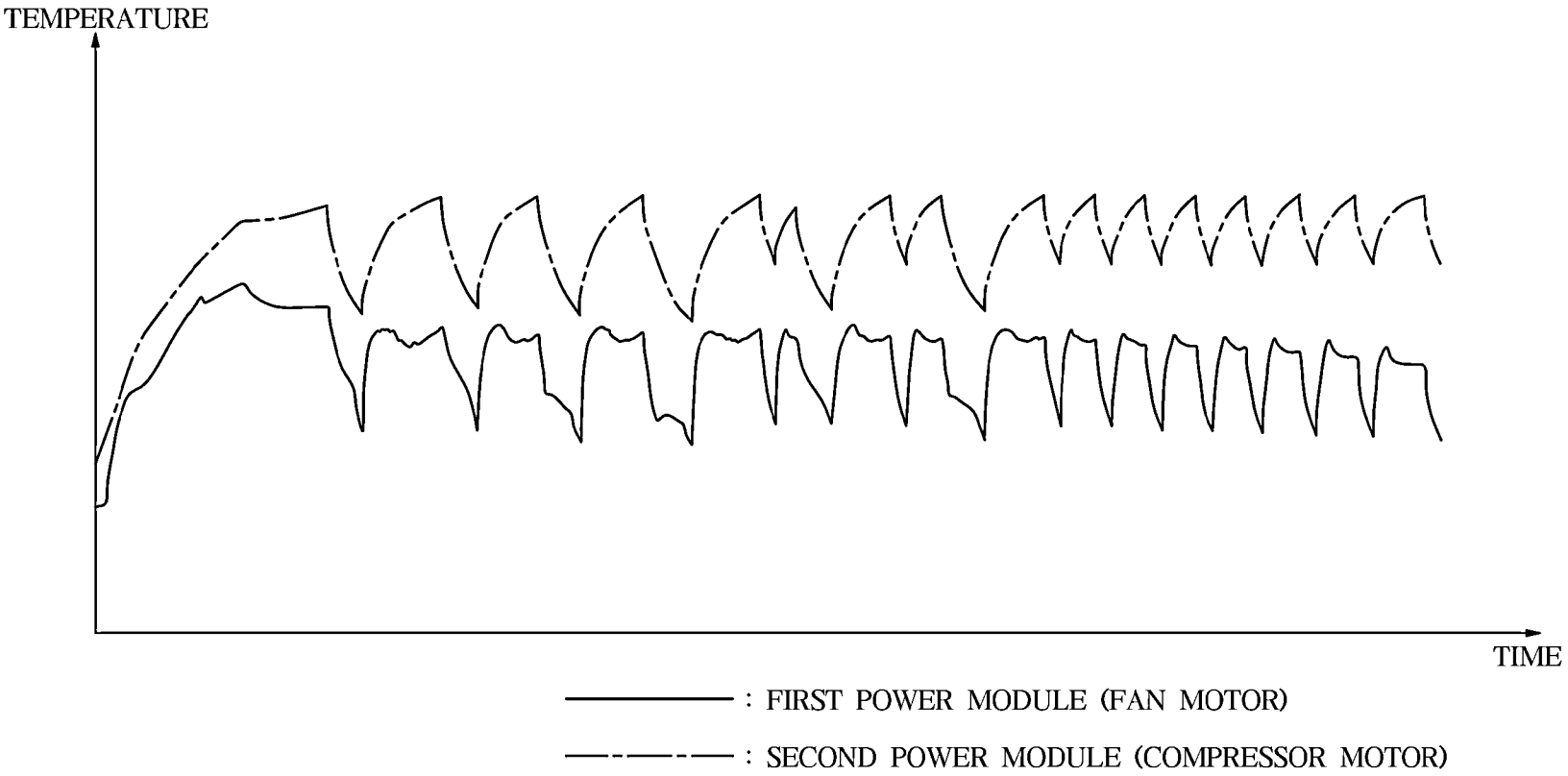
FIG. 6 illustrates graphs showing operations of a compressor, caused by an increase in temperature of power modules due to a failure of a cooling device in a dryer according to an embodiment of the disclosure.
Figure 7:
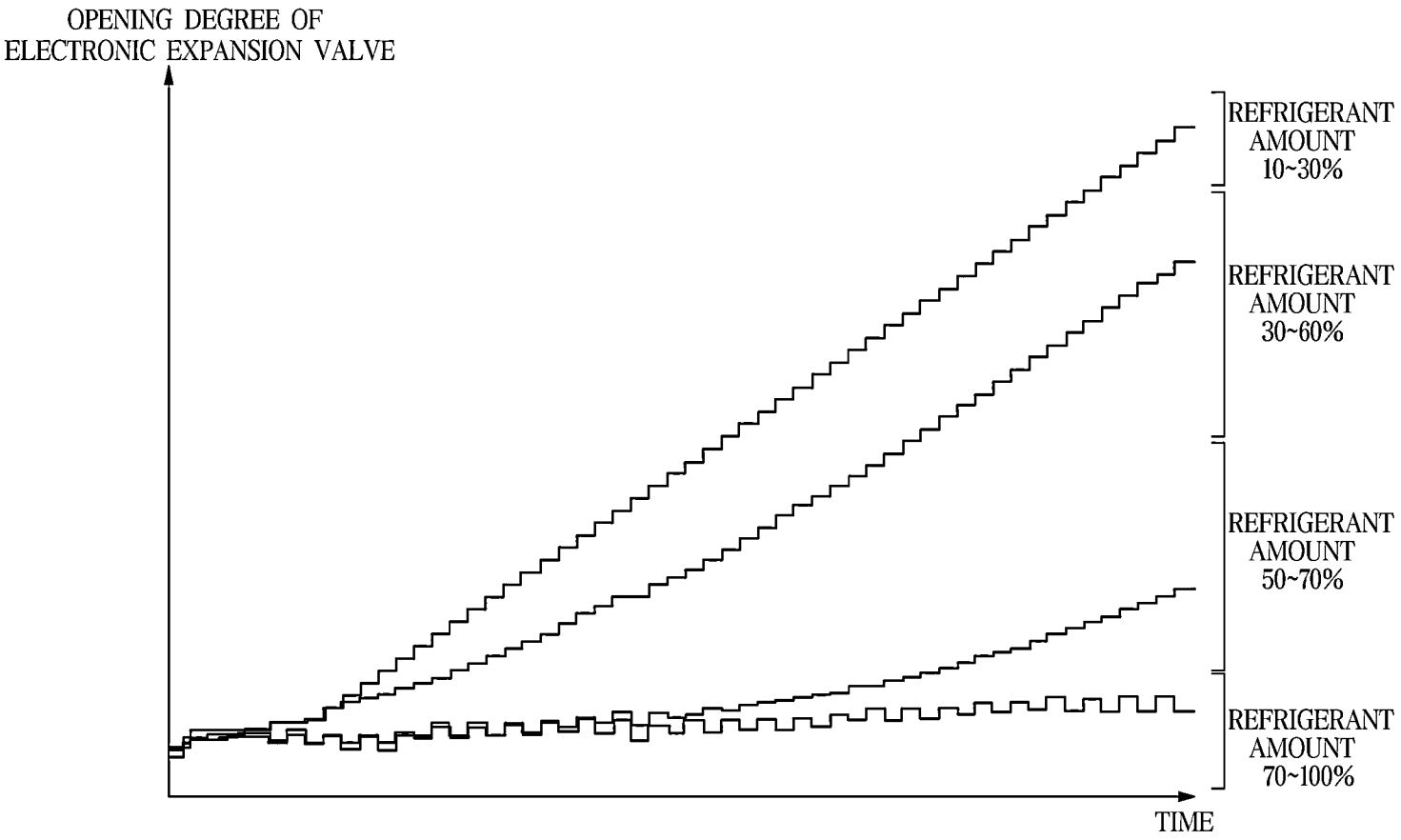
FIG. 7 illustrates graphs showing opening degrees of an electronic expansion valve according to refrigerant amounts in a dryer according to an embodiment of the disclosure.

FIG. 5 illustrates graphs showing operations of the compressor 161, caused by a rise in temperature of the compressor 161 due to clogging of the duct 50 in the dryer 1 according to an embodiment, FIG. 6 illustrates graphs showing operations of the compressor 161, caused by a rise in temperature of the power module 180 due to a failure of the cooling device 190 in the dryer 1 according to an embodiment, and FIG. 7 illustrates graphs showing opening degrees of the electronic expansion valve 163 according to refrigerant amounts in the dryer 1 according to an embodiment.

Referring to FIGS. 5 to 7, the controller 150 according to an embodiment may identify a factor to be controlled from among a plurality of factors that cause incomplete drying, based on at least one of output data from the plurality of temperature sensors 110 or opening degree data of the electronic expansion valve 163 provided in the heat pump 160. The factor to be controlled may be a factor that is predicted to actually cause incomplete drying and correspond to a factor on which an action for preventing incomplete drying needs to be performed.

For example, the plurality of factors that may cause incomplete drying may include clogging of the duct 50, a failure of the cooling device 190, refrigerant insufficiency of the heat pump 160, a failure of the heater 170, etc.

At this time, the controller 150 may obtain output data from the temperature sensors 110, and obtain opening degree data of the electronic expansion valve 163 based on an electronic signal for changing an opening degree of the electronic expansion valve 163.

The operation of detecting the factor to be controlled may be performed according to a start of a drying operation or in a case in which an operation time of a drying operation exceeds an expected time, according to embodiments. For example, the operation of detecting the factor to be controlled may be performed in a case in which an operation time of a drying operation becomes longer by a preset time or more than the expected time.

The controller 150 according to an embodiment may control the storage device 120 to store output data from the plurality of temperature sensors 110 and opening degree data of the electronic expansion valve 163 whenever a drying operation is performed.

Also, the controller 150 according to an embodiment may identify a factor to be controlled by comparing at least one of output data from the plurality of temperature sensors 110 or opening degree data of the electronic expansion valve 163 of the heat pump 160 during a drying operation with stored data.

That is, the controller 150 may compare at least one of output data from the temperature sensors 110 or opening degree data of the electronic expansion valve 163 in a drying operation being currently performed, with data in a previous drying operation, stored in the storage device 120, to identify a factor to be controlled in the current drying operation.

Referring to FIG. 5, in a case in which a number of times by which at least one of temperature of the duct 50 or temperature of the compressor 161 deviates from a preset temperature range increases in comparison with temperature of data stored in the storage device 120, the controller 150 may identify clogging of the duct 50 among the plurality of factors as a factor to be controlled.

That is, the controller 150 may identify clogging of the duct 50 as a factor to be controlled, based on output data from the third temperature sensor 110*c* provided on the duct 50 around the outlet 21*b* to detect temperature of the duct 50 and the fifth temperature sensor 110*d* provided in one side of the compressor 161 to detect temperature of the compressor 161.

As drying operations are repeatedly performed, foreign materials may be collected on the filter 23 provided in the outlet 21*b*, the duct 50, and a surface of the evaporator 164, and air circulation in the duct 50 may be not smooth due to the foreign materials.

Accordingly, heat of the duct 50 may not circulate, resulting in a rise of inside temperature of the duct 50. Also, due to the rise of inside temperature of the duct 50, temperature of the compressor 161 or temperature of the heater 170 may rise.

In a case in which temperature of the compressor 161 exceeds preset temperature during a drying operation, the compressor 161 may stop compressing temporarily according to a control by the controller 150 to be cooled.

Accordingly, in the case in which the inside temperature of the duct 50 rises due to clogging of the duct 50, a case in which the temperature of the compressor 161 exceeds the preset temperature may increase, which increases a number of times by which a protection operation for the compressor 161 is performed, resulting in an increase of a number of times by which the compressor 161 is interrupted.

The compressor 161 may perform, as shown in (a) of FIG. 5, a drying operation without an interruption in a case in which a drying operation is performed one or two times, because temperature of the compressor 161 does not exceed the preset temperature.

However, as shown in (b) of FIG. 5, the compressor 161 may be interrupted several times for cooling during a drying operation in a case in which a drying operation is performed two to four times, because a number of times by which temperature of the compressor 161 exceeds the preset temperature is more than in the case in which a drying operation is performed one or two times.

It may be seen from (c) of FIG. 5 representing temperature of the compressor 161 in a case in which a drying operation is performed three to five times and (d) of FIG. 5 representing temperature of the compressor 161 in a case in which a drying operation is performed five to seven times, that a number of operation interruptions for cooling increases because a number of times by which the temperature of the compressor 161 exceeds the preset temperature increases due to clogging of the duct 50 according to an increase in number of drying operations.

As such, as a number of interruptions of the compressor 161 increases, an operation time of a drying operation may be delayed and incomplete drying may occur.

Accordingly, the controller 150 may detect an increase of a number of interruptions of the compressor 161 due to a temperature rise according to clogging of the duct 50 by detecting temperature of the duct 50 or the compressor 161 to thus identify that a number of times by which the temperature of the compressor 161 exceeds the preset temperature has increased in comparison with that in a previous drying operation, thereby identifying clogging of the duct 50 as a factor to be controlled.

Accordingly, in a case in which clogging of the duct 50 as a factor to be controlled is output as a notification, a user may prevent incomplete drying of the dryer 1 by removing foreign materials collected in the filter 23, the duct 50, or the evaporator 164.

Also, the controller 150 may identify a failure of the heater 170 as a factor to be controlled by detecting temperature of the heater 170, like the operation of identifying a factor to be controlled by detecting temperature of the compressor 161. At this time, the controller 150 may identify a failure of the heater 170 based on a sixth temperature sensor 110*f* provided on one side of the heater 170 to detect temperature of the heater 170.

More specifically, the controller 150 may detect temperature of the heater 170 to identify whether a number of times by which the temperature of the heater 170 deviates from a preset temperature range increases in comparison with that in a previous drying operation, and thereby identify that a number of interruptions of the heater 170 has increased due to a temperature rise of the heater 170 to identify a failure of the heater 170 as a factor to be controlled.

At this time, the temperature of the heater 170 may rise by clogging of the duct 50 or foreign materials collected around the heater 170.

Also, the temperature of the heater 170 may be due to an increase of a number of interruptions of the fan 40, caused by a protection operation of the first power module 180*a* according to a failure of the cooling device 190. That is, in a case in which an operation of controlling power supply to the drum motor 25 is interrupted as a protection operation for the first power module 180*a*, the fan 40 may also be interrupted, air circulation in the duct 50 may be not smooth, and a number of times by which temperature of the heater 170 exceeds the preset temperature may increase due to an increase in inside temperature of the duct 50.

Accordingly, in a case in which a failure of the heater 170 as a factor to be controlled is output as a notification, the user may prevent incomplete drying of the dryer 1 by removing foreign materials collected in the heater 170. Also, by performing an action corresponding to clogging of the duct 50 or an action corresponding to a failure of the cooling device 190, incomplete drying may be prevented.

Referring to FIG. 6, in a case in which a number of times by which temperature of the power module 180 deviates from a preset temperature range increases in comparison with temperature of data stored in the storage device 120, the controller 150 may identify a failure of the cooling device 190 among the plurality of factors as a factor to be controlled.

The power module 180 may be heated based on a control on power supply to the drum motor 25 and the motor of the compressor 161 as a drying operation is progressed. At this time, the cooling device 190 may cool the power module 180, and accordingly, the power module 180 may continue to perform a power supply control.

However, in a case in which a failure, such as a cross connection or a short circuit, of the cooling device 190 occurs, the cooling device 190 may fail to operate, and temperature of the power module 180 may rise abnormally.

At this time, in a case in which temperature of the power module 180, detected by the temperature sensors 110, exceeds the preset temperature, the controller 150 may interrupt the operation of the power module 180 to cool the power module 180. That is, the controller 150 may interrupt the operation of the first power module 180*a* based on an output from the first temperature sensor 110*a*, and interrupt the operation of the second power module 180*b* based on an output from the second temperature sensor 110*b*.

More specifically, temperature of the first power module 180*a* that controls power supply to the drum motor (fan motor) 25 may increase, as shown in FIG. 6, as a drying operation is progressed, and the temperature of the first power module 180*a* may decrease according to an operation interruption of the first power module 180*a* as a protection operation against the excess of the preset temperature. As such, temperature of the first power module 180*a* may repeatedly increase and decrease by an operation interruption as a protection operation and an operation resumption after a protection operation.

Also, temperature of the second power module 180*b* that controls power supply to the motor of the compressor 161 may increase, as shown in FIG. 6, as a drying operation is progressed, and the temperature of the second power module 180*b* may decrease according to an operation interruption of the second power module 180*b* as a protection operation against the excess of the preset temperature. As such, temperature of the second power module 180*b* may repeatedly increase and decrease by an operation interruption as a protection operation and an operation resumption after a protection operation.

As such, in a case in which the cooling device 190 does not operate, a number of times by which temperature of the power module 180 deviates from the preset temperature range may increase. Accordingly, a number of times by which an operation of the power module 180 is interrupted may increase, and a number of times by which operations of the drum 20, the fan 40, and the compressor 161 are interrupted may also increase. As a result, a drying operation may be delayed due to the operation interruptions of the drum 20, the fan 40, and the compressor 161, thus an operation time of the drying operation may become longer than the expected time, and incomplete drying may occur.

Accordingly, in a case in which a number of times by which temperature indicated by output data from the first temperature sensor 110*a* or the second temperature sensor 110*b* for detecting temperature of the power module 180 deviates from the preset temperature range increases in comparison with that in a previous drying operation, the controller 150 may identify that a failure of the cooling device 190 for cooling the cooling module 180 has occurred, and identify the failure of the cooling device 190 as a factor to be controlled.

Accordingly, in a case in which the failure of the cooing device 190 as the factor to be controlled is output as a notification, the user may prevent incomplete drying of the dryer 1 by repairing or replacing the cooling device 190.

Referring to FIG. 7, in a case in which an opening degree of the electronic expansion valve 163 exceeds an opening degree of stored opening degree data during a drying operation, the controller 150 may identify refrigerant insufficiency of the heat pump 160 among the plurality of factors as a factor to be controlled.

Also, in a case in which temperature of a refrigerant discharged from the compressor 161 is lower than temperature of stored data during a drying operation, the controller 150 may identify refrigerant insufficiency of the heat pump 160 among the plurality of factors as a factor to be controlled.

The heat pump 160 may perform heat exchange with air by circulating a refrigerant during a drying operation. At this time, the refrigerant accommodated in the heat pump 160 may be discharged to the outside as a number of times by which a drying operation is performed increases. As such, in a case in which refrigerant insufficiency of the heat pump 160 occurs due to refrigerant leakage to the outside of the heat pump 160, heat exchange efficiency of the heat pump 160 may be lowered. Accordingly, in a case in which refrigerant insufficiency of the heat pump 160 occurs, incomplete drying may occur.

In the case in which refrigerant insufficiency of the heat pump 160 occurs due to refrigerant leakage to the outside of the heat pump 160, the controller 150 may control the electronic expansion valve 163 to increase an opening degree in order to increase heat exchange efficiency of the heat pump 160. The opening degree of the electronic expansion valve 163 may increase as a refrigerant amount is reduced, as shown in FIG. 7. For example, an opening degree of the electronic expansion valve 163 in a case in which a refrigerant amount ranges from 70% to 100% may be smaller than an opening degree of the electronic expansion valve 163 in a case in which a refrigerant amount ranges from 50% to 70%.

Accordingly, in a case in which an opening degree of the electronic expansion valve 163 in a current drying operation deviates from an opening degree range in a previous drying operation, the controller 150 may identify refrigerant insufficiency among the plurality of factors as a factor to be controlled.

Also, in the case in which refrigerant insufficiency of the heat pump 160 occurs, heat exchange efficiency of the heat pump 160 may deteriorate, and accordingly, temperature of a refrigerant discharged from the compressor 161 may be lowered.

Accordingly, in a case in which temperature of a refrigerant in a current drying operation exceeds temperature of a refrigerant in a previous drying operation based on output data from the fourth temperature sensor 110*d* that detects temperature of a refrigerant discharged from the compressor 161, the controller 150 may identify refrigerant insufficiency of the heat pump 160 among the plurality of factors as a factor to be controlled.

Accordingly, in a case in which the refrigerant insufficiency of the heat pump 160 as the factor to be controlled is output as a notification, the user may prevent incomplete drying of the dryer 1 by adding a refrigerant of the heat pump 160.

As such, the dryer 1 may identify a factor to be controlled in a current drying operation from among the plurality of factors that may cause incomplete drying, by using at least one of output data from the temperature sensors 110 or opening degree data of the electronic expansion valve 163. That is, the dryer 1 according to the disclosure may clearly diagnose a factor that may actually cause incomplete drying from among the plurality of factors that may cause incomplete drying, in addition to predicting incomplete drying.

Figure 8:
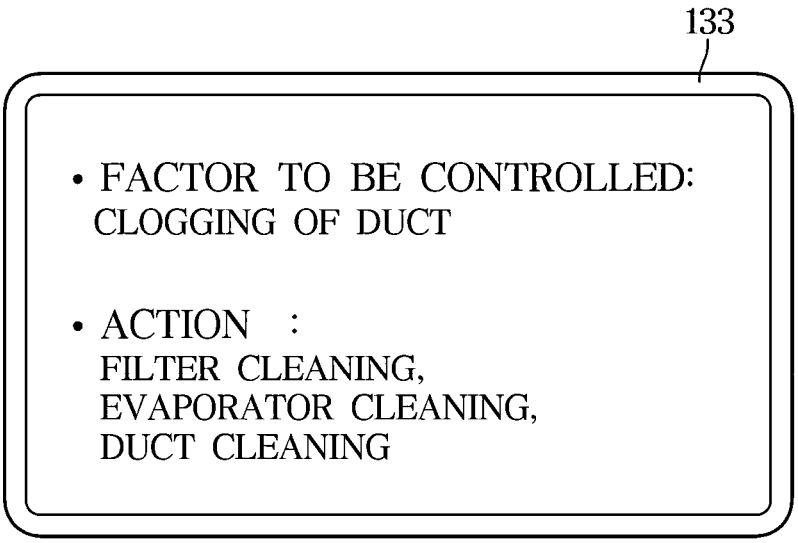
FIG. 8 shows a case of outputting a notification for a factor to be controlled in a dryer according to an embodiment of the disclosure.
Figure 9:
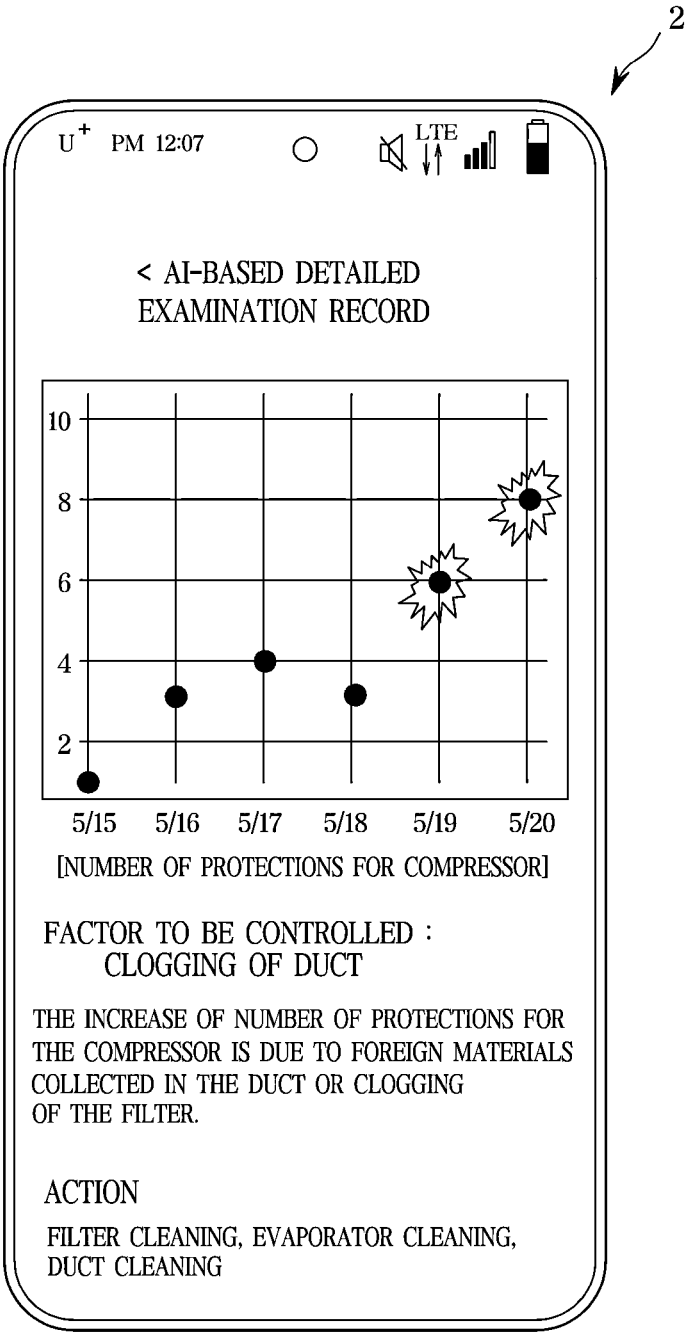
FIG. 9 shows a case of transmitting a factor to be controlled to an external electronic device in a dryer according to an embodiment of the disclosure.

FIG. 8 shows a case of outputting a notification for a factor to be controlled in the dryer 1 according to an embodiment, and FIG. 9 shows a case of transmitting a factor to be controlled to an external electronic device in the dryer 1 according to an embodiment.

Referring to FIG. 8, after a factor to be controlled is identified, the controller 150 according to an embodiment may control the user interface 130 to output a notification for the factor to be controlled.

That is, the controller 150 may control the display 133 of the user interface 130 to display the factor to be controlled. For example, the display 133 may display that the factor to be controlled is clogging of the duct 50, as shown in FIG. 8. However, according to embodiments, the controller 150 may control the speaker of the user interface 130 to output the factor to be controlled as a voice message.

The user interface 130 may display an explanation about the factor to be controlled, according to embodiments. For example, the user interface 130 may display content indicating that clogging of the duct 50 has been identified by an increase of a number of protections for the compressor and explaining a reason for the clogging of the duct 50. At this time, according to embodiments, the user interface 130 may display a number of protection operations for the compressor, generated in a case in which temperature of the compressor 161 exceeds preset temperature according to clogging of the duct 50, partitively for each drying operation, in a form of a graph, thereby enabling a user to more intuitively recognize a factor to be controlled.

Thereby, the user may recognize a factor that may cause incomplete drying among a plurality of factors, and prevent generation of incomplete drying by performing an action for the factor to be controlled before incomplete drying occurs.

Also, according to embodiments, the controller 150 may control the user interface 130 to further output content of the action corresponding to the factor to be controlled.

That is, the controller 150 may control the display 133 of the user interface 130 to display content of the action corresponding to the factor to be controlled. For example, the display 133 may display filter cleaning, evaporator cleaning, or duct cleaning as content of the action corresponding to the factor to be controlled, as shown in FIG. 8. However, according to embodiments, the controller 150 may control the speaker of the user interface 130 to output content of the action corresponding to the factor to be controlled as a voice message.

Thereby, the user may easily manage the dryer by recognizing the content of the action required for the factor to be controlled.

Also, as shown in FIG. 9, the controller 150 according to an embodiment may control, after a factor to be controlled is identified, the communicator 140 to transmit a notification for the factor to be controlled to the external electronic device 2.

In this case, the external electronic device 2 may output the factor to be controlled visually or acoustically. For example, the external electronic device 2 may display that the factor to be controlled is clogging of the duct 50, as shown in FIG. 9.

According to embodiments, the external electronic device 2 may display an explanation about the factor to be controlled. For example, the external electronic device 2 may display content indicating that clogging of the duct 50 has been identified by an increase of a number of protections for the compressor and explaining a reason for the clogging of the duct 50. At this time, according to embodiments, the user interface 130 may display a number of protection operations for the compressor, generated in a case in which temperature of the compressor 161 exceeds preset temperature due to clogging of the duct 50, partitively for each drying operation, in a form of a graph, thereby enabling a user to more intuitively recognize the factor to be controlled.

Also, the controller 150 according to an embodiment may control the communicator 140 to transmit content of an action corresponding to the factor to be controlled to the external electronic device 2. In this case, the external electronic device 2 may output the content of the action corresponding to the factor to be controlled visually or acoustically.

Thereby, the user may recognize, even when he/she is not located around the dryer 1, a factor that may cause incomplete factor from among a plurality of factors, and prevent generation of incomplete drying by performing an action for the factor to be controlled before incomplete drying occurs.

As such, the dryer 1 may identify a factor to be controlled in a current drying operation from among the plurality of factors that may cause incomplete drying, by using at least one of output data from the temperature sensor 110 or opening degree data of the electronic expansion valve 163. Thereby, the dryer 1 may clearly provide the user with a factor that is predicted to cause incomplete drying among various factors, and as a result, incomplete drying of the dryer 1 may be prevented.

Hereinafter, an embodiment of a method for controlling the dryer 1 according to an aspect will be described. In the method for controlling the dryer 1, the dryer 1 according to the above-described embodiment may be used. Accordingly, content described with reference to FIGS. 1 to 9 may be applied in the same way to the method for controlling the dryer 1.

Figure 10:
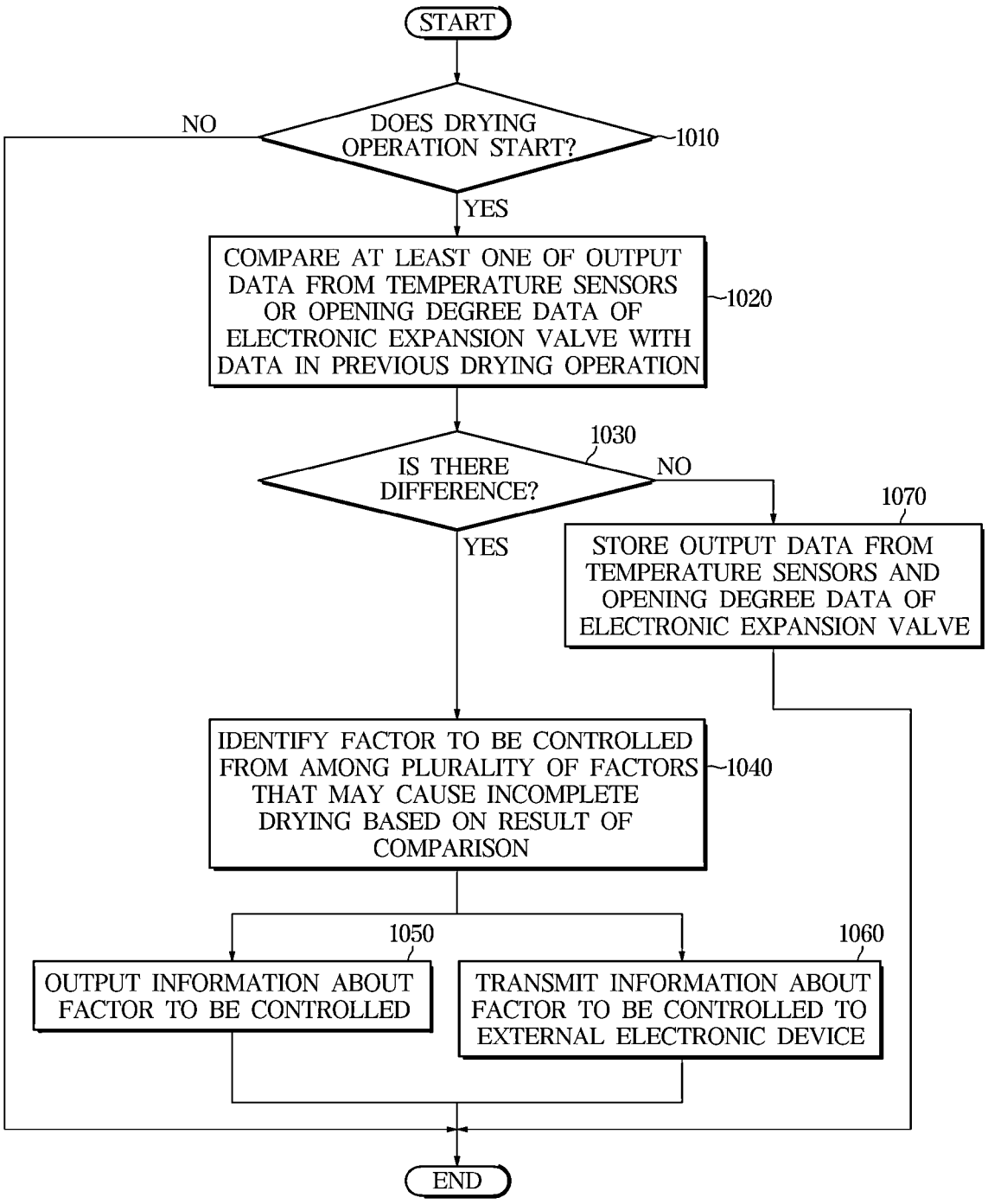
FIG. 10 is a flowchart showing a case of identifying a factor to be controlled in a method for controlling a dryer according to an embodiment of the disclosure.

FIG. 10 is a flowchart showing a case of identifying a factor to be controlled in a method for controlling the dryer 1 according to an embodiment.

Referring to FIG. 10, the dryer 1 according to an embodiment may compare, in a case in which a drying operation starts (YES in 1010), at least one of output data from the temperature sensors 110 or opening degree data of the electronic expansion valve 163 with data in a previous drying operation (1020).

In a case in which there is a difference between the at least one of the output data from the temperature sensors 110 or the opening degree data of the electronic expansion valve 163 and the data in the previous drying operation (YES in 1030), the dryer 1 may identify a factor to be controlled from among a plurality of factors that may cause incomplete drying, based on a result of the comparison (1040).

That is, the controller 150 may identify a factor to be controlled from among a plurality of factors that may cause incomplete drying, based on at least one of output data from the plurality of temperature sensors 110 or opening degree data of the electronic expansion valve 163 provided in the heat pump 160. The factor to be controlled may be a factor that is predicted to actually cause incomplete drying and correspond to a factor on which an action for preventing incomplete drying needs to be performed.

For example, the plurality of factors that may cause incomplete drying may include clogging of the duct 50, a failure of the cooling device 190, refrigerant insufficiency of the heat pump 160, a failure of the heater 170, etc.

At this time, the controller 150 may obtain output data from the temperature sensors 110, and obtain opening degree data of the electronic expansion valve 163 based on an electrical signal for changing an opening degree of the electronic expansion valve 163.

The controller 150 may compare, while a drying operation is performed, at least one of the output data from the plural of temperature sensors 110 or the opening degree data of the electronic expansion valve 163 of the heat pump 160 with stored data to identify a factor to be controlled.

That is, the controller 150 may identify a factor to be controlled in a current drying operation by comparing at least one of output data from the temperature sensors 110 or opening degree data of the electronic expansion valve 63 in the current drying operation with data in a previous drying operation, stored in the storage device 120.

More specifically, in a case in which a number of times by which at least one of temperature of the duct 50 or temperature of the compressor 161 deviates from a preset temperature range increases in comparison with temperature of data stored in the storage device 120, the controller 150 may identify clogging of the duct 50 among the plurality of factors as a factor to be controlled.

Also, in a case in which a number of times by which temperature of the power module 180 deviates from a preset temperature range increases in comparison with temperature of data stored in the storage device 120, the controller 150 may identify a failure of the cooling device 190 among the plurality of factors as a factor to be controlled.

Also, in a case in which an opening degree of the electronic expansion valve 163 deviates from an opening degree range of stored opening degree data during a drying operation, the controller 150 may identify refrigerant insufficiency of the heat pump 160 among the plurality of factors as a factor to be controlled.

Also, in a case in which temperature of a refrigerant discharged from the compressor 161 deviates from a temperature range of stored data during a drying operation, the controller 150 may identify refrigerant insufficiency of the heat pump 160 among the plurality of factors as a factor to be controlled.

Also, in a case in which a number of times by which temperature of the heater 170 deviates from a preset temperature range increases in comparison with temperature of stored data, the controller 150 may identify a failure of the heater 170 as a factor to be controlled.

The controller 1 according to an embodiment may output information about the factor to be controlled (1050).

That is, the controller 150 may control, after the factor to be controlled is identified, the user interface 130 to output a notification for the factor to be controlled. For example, the controller 150 may control the display 133 of the user interface 130 to display the factor to be controlled, or the speaker of the user interface 130 to output the factor to be controlled as a voice message.

Also, according to embodiments, the controller 150 may control the user interface 130 to output content of an action corresponding to the factor to be controlled. For example, the controller 150 may control the display 133 of the user interface 130 to display the content of the action corresponding to the factor to be controlled, or the speaker of the user interface 130 to output the content of the action corresponding to the factor to be controlled as a voice message.

Thereby, a user may recognize a factor that may cause incomplete drying from among a plurality of factors, and prevent generation of incomplete drying by performing an action for the factor to be controlled before incomplete drying occurs.

Also, the dryer 1 according to an embodiment may transmit information about the factor to be controlled to the external electronic device 2 (1060).

That is, the controller 150 may control, after the factor to be controlled is identified, the communicator 140 to transmit a notification for the factor to be controlled to the external electronic device. Also, the controller 150 may control the communicator 140 to transmit content of the action corresponding to the factor to be controlled to the external electronic device.

Thereby, the user may recognize, even when he/she is not located around the dryer 1, a factor that may cause incomplete factor from among the plurality of factors, and prevent generation of incomplete drying by performing an action for the factor to be controlled before incomplete drying occurs.

At this time, in a case in which there is no difference between the at least one of the output data from the temperature sensors 110 or the opening degree data of the electronic expansion valve 163 and the data in the previous drying operation (NO in 1030), the dryer 1 according to an embodiment may (1020) may store the output data from the temperature sensors 110 and the opening degree data of the electronic expansion valve 163 (1070).

That is, the controller 150 may control, whenever a drying operation is performed, the storage device 120 to store output data from the plurality of temperature sensors 110 and opening degree data of the electronic expansion valve 163. Thereby, the dryer 1 may store data of a previous drying operation, and compare data of a current drying operation with the data of the previous drying operation to identify a factor to be controlled in the current drying operation.

Figure 11:
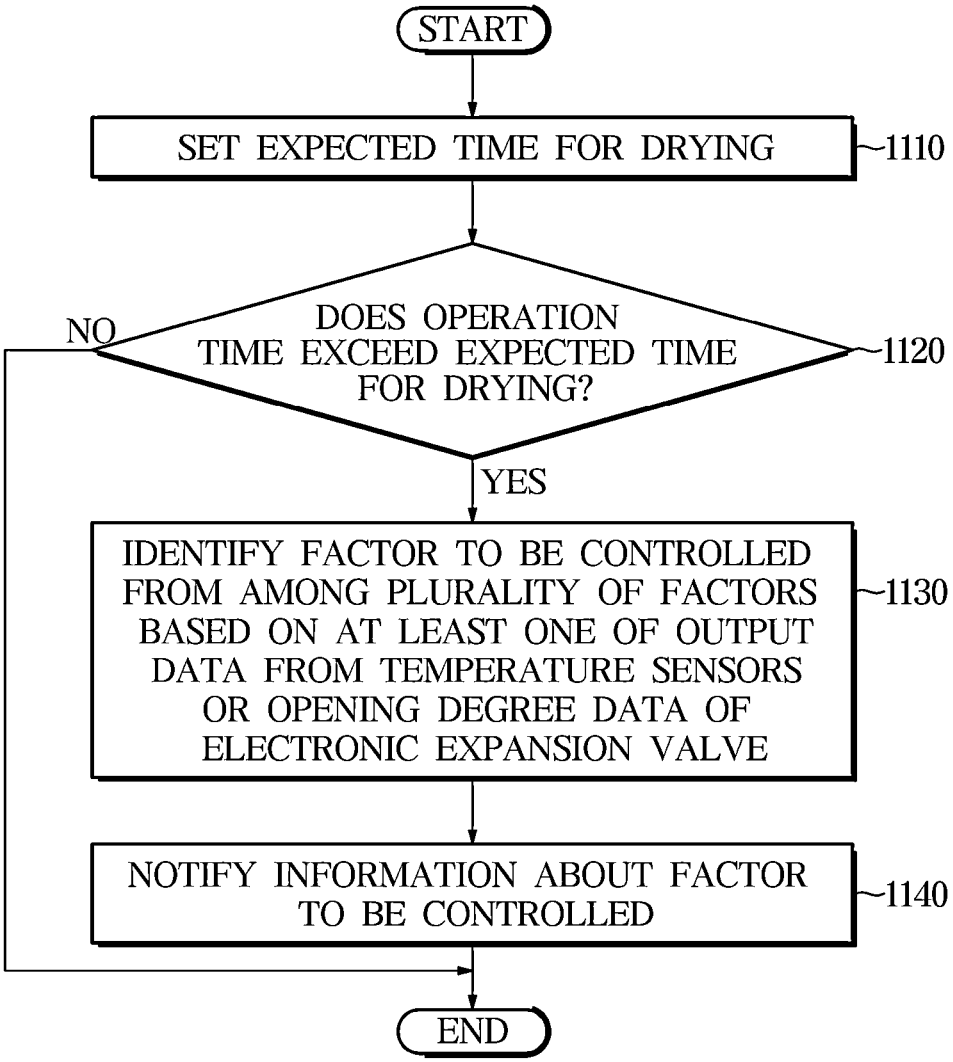
FIG. 11 is a flowchart showing a case of starting identification on a factor to be controlled in a method for controlling a dryer according to an embodiment of the disclosure.

FIG. 11 is a flowchart showing a case of starting identification of a factor to be controlled in a method for controlling the dryer 1 according to an embodiment.

Referring to FIG. 11, the dryer 1 according to an embodiment may set an expected time for drying (1110).

That is, the controller 150 may set an expected time for a drying operation based on a drying mode set through the inputters 131*a* and 131*b*, a weight of laundry measured by a weight sensor (not shown), etc.

Also, the controller 150 may set a termination time of a drying operation by measuring a dryness of laundry based on a temperature difference, etc., between air entering an electrode sensor (not shown) or the drum 20 and air discharged from the electrode sensor or the drum 20.

The operation of setting the expected time of the drying operation and the operation of setting the termination time of the drying operation may be performed as known operations, instead of the above-described examples.

In a case in which an operation time of the drying operation exceeds the expected time for drying (YES in 1120), the dryer 1 according to an embodiment may identify a factor to be controlled from among a plurality of factors based on at least one of output data from the temperature sensors 110 or opening degree data of the electronic expansion valve 163 (1130).

In the case in which the operation time of the drying operation becomes longer than the expected time, the controller 150 may start an operation for identifying a factor to be controlled with respect to incomplete drying. That is, in the case in which the operation time becomes longer than the expected time, the dryer 1 may start an operation for identifying a factor to be controlled under an assumption that there is a factor causing incomplete drying. For example, in the case in which the operation time of the drying operation becomes longer by a preset time or more than the expected time, the controller 150 may start an operation for identifying a factor to be controlled.

For example, in a case in which the compressor 161 is interrupted temporarily as a protection operation for the compressor 161 or the heater 170 is interrupted temporarily as a protection operation for the heater 170, an operation time of a drying operation may be lengthened. Also, in a case in which heat exchange performance deteriorates due to refrigerant insufficiency of the heat pump 160 or the power module 180 is interrupted temporarily due to a failure of the cooling device 190, an operation time of a drying operation may be lengthened.

The dryer 1 according to an embodiment may notify information about the factor to be controlled (1140).

After the factor to be controlled is identified, the controller 150 according to an embodiment may control the user interface 130 to output a notification for the factor to be controlled. For example, the controller 150 may control the display 133 of the user interface 130 to display the factor to be controlled, or the speaker of the user interface 130 to output the factor to be controlled as a voice message.

Also, according to embodiments, the controller 150 may control the user interface 130 to output content of an action corresponding to a factor to be controlled. For example, the controller 150 may control the display 133 of the user interface 130 to display the content of the action corresponding to the factor to be controlled, or the speaker of the user interface 130 to output the content of the action corresponding to the factor to be controlled as a voice message.

Thereby, a user may recognize a factor that may cause incomplete drying from among the plurality of factors, and prevent generation of incomplete drying by performing the action corresponding to the factor to be controlled before incomplete drying occurs.

The controller 150 according to an embodiment may control, after the factor to be controlled is identified, the communicator 140 to transmit a notification for the factor to be controlled to an external electronic device. Also, the controller 150 may control the communicator 140 to transmit the content for the action corresponding to the factor to be controlled to the external electronic device.

Thereby, the user may recognize, even when he/she is not located around the dryer 1, a factor that may cause incomplete drying from among the plurality of factors, and prevent generation of incomplete drying by performing an action for the factor to be controlled before incomplete drying occurs.

Embodiments of the disclosure may provide a method for controlling a dryer, the dryer including a drum, a heat pump, a user interface, a power module configured to control power supply to a compressor motor of the heat pump and a drum motor connected with the drum, and a duct accommodating an evaporator and a condenser of the heat pump and configured to heat air flowing in from the drum and discharge the air to the drum, includes: identifying a factor to be controlled from among a plurality of factors causing incomplete drying, based on at least one of output data from a plurality of temperature sensors configured to detect temperature of each of the heat pump, the power module, and the duct or opening degree data of an electronic expansion valve provided in the heat pump; and controlling the user interface to output a notification for the factor to be controlled.

The identifying of the factor to be controlled may include identifying the factor to be controlled in a case in which an operation time of a drying operation becomes longer by a preset time or more than an expected time.

The dryer may further include a storage device, wherein the identifying of the factor to be controlled may include: controlling the storage device to store, whenever a drying operation is performed, output data from the plurality of temperature sensors and opening degree data of the electronic expansion valve; and identifying the factor to be controlled while a drying operation is performed by comparing at least one of output data from the plurality of temperature sensors or opening degree data of an electronic expansion valve of the heat pump with stored data.

The identifying of the factor to be controlled may include identifying clogging of the duct as the factor to be controlled in a case in which a number of times by which at least one of temperature of the duct or temperature of a compressor of the heat pump deviates from a preset temperature range increases in comparison with temperature of the stored data.

The identifying of the factor to be controlled may include identifying a failure of a cooling device cooling the power module as the factor to be controlled in a case in which a number of times by which temperature of the power module deviates from a preset temperature range increases in comparison with temperature of the stored data.

The identifying of the factor to be controlled may include identifying refrigerant insufficiency of the heat pump as the factor to be controlled in a case in which an opening degree of the electronic expansion valve deviates from an opening degree range of the stored opening degree data during a drying operation.

The identifying of the factor to be controlled may include identifying refrigerant insufficiency of the heat pump as the factor to be controlled in a case in which temperature of a refrigerant discharged from a compressor of the heat pump deviates from a temperature range of the stored data during a drying operation.

The dryer may further include a heater provided in the duct and configured to heat air discharged from the drum, wherein the identifying of the factor to be controlled may include identifying a failure of the heater as the factor to be controlled in a case in which a number of times by which temperature of the heater deviates from a preset temperature range increases in comparison with temperature of the stored data.

The dryer may further include a communicator, wherein the method for controlling the dryer may further include controlling the communicator to transmit the notification for the factor to be controlled to an external electronic device.

The method for controlling the dryer may further include controlling the user interface to output content of an action corresponding to the factor to be controlled.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be ROM, RAM, a magnetic tape, a magnetic disc, a flash memory, an optical data storage device, etc.

So far, the disclosed embodiments have been described with reference to the accompanying drawings. It will be apparent that those skilled in the art can make various modifications thereto without changing the technical spirit and essential features of the present disclosure. Thus, it should be understood that the embodiments described above are merely for illustrative purposes and not for limitation purposes.

What is claimed is:

1. A dryer comprising:

a drum;

a drum motor connected to the drum;

a heat pump including:

a compressor including a compressor motor, an evaporator, a condenser, and an electronic expansion valve;

a user interface;

a power module configured to control power supply to the compressor motor and the drum motor;

a duct accommodating the evaporator and the condenser, and configured to:

receive air from the drum so that the received air flows in the duct to be heated by operation of the evaporator and the condenser, and discharge the heated air to the drum;

a plurality of temperature sensors configured to detect temperature of each of the heat pump, the power module, and the duct;

a storage device; and a controller configured to:

control the storage device to store, whenever a drying operation is performed, output data from the plurality of temperature sensors and opening degree data of the electronic expansion valve, identify a factor to be controlled while the drying operation is performed, from among a plurality of factors that may cause incomplete drying, by comparing at least one of the output data from the plurality of temperature sensors and the opening degree data of the electronic expansion valve with the stored data, and control the user interface to output a notification of the identified factor to be controlled, wherein the plurality of factors that may cause incomplete drying include clogging of the duct, a failure of a cooling device cooling the power module, and a refrigerant insufficiency of the heat pump.

2. The dryer of claim 1, wherein the controller is configured to identify the factor to be controlled in a case in which an operation time of a drying operation becomes longer by a preset time or longer than an expected time.

3. The dryer of claim 1, wherein the controller is configured to identify clogging of the duct as the factor to be controlled in a case in which a number of times by which at least one of temperature of the duct and temperature of the compressor deviates from a corresponding preset temperature range increases in comparison with the stored output data from the plurality of temperature sensors.

4. The dryer of claim 1, further comprising:

a cooling device to cool the power module, wherein the controller is configured to identify a failure of the cooling device as the factor to be controlled in a case in which a number of times by which temperature of the power module deviates from a preset temperature range increases in comparison with the stored output data from the plurality of temperature sensors.

5. The dryer of claim 1, wherein the controller is configured to identify refrigerant insufficiency of the heat pump as the factor to be controlled in a case in which the opening degree of the electronic expansion valve deviates from an opening degree range of the stored opening degree data of the electronic expansion valve during a drying operation.

6. The dryer of claim 1, wherein the controller is configured to identify refrigerant insufficiency of the heat pump as the factor to be controlled in a case in which temperature of a refrigerant discharged from the compressor deviates from a temperature range of the stored output data from the plurality of temperature sensors during a drying operation.

7. The dryer of claim 1, further comprising:

a heater provided in the duct and configured to heat the received air in the duct, wherein the controller is configured to identify a failure of the heater as the factor to be controlled in a case in which a number of times by which temperature of the heater deviates from a preset temperature range increases in comparison with the stored output data from the plurality of temperature sensors.

8. The dryer of claim 1, further comprising:

a communicator, wherein the controller is configured to control the communicator to transmit the notification of the factor to be controlled to an external electronic device.

9. The dryer of claim 1, wherein the controller is configured to control the user interface to output content of an action corresponding to the factor to be controlled.

10. A method of controlling a dryer, the dryer including a drum, a drum motor connected to the drum, a heat pump including a compressor including a compressor motor, an evaporator, a condenser, and an electronic expansion valve, a user interface, a power module configured to control power supply to the compressor motor and the drum motor, a duct accommodating the evaporator and the condenser, and configured to receive air from the drum so that the received air flows in the duct to be heated by operation of the evaporator and the condenser, and discharge the heated air to the drum, a plurality of temperature sensors configured to detect temperature of each of the heat pump, the power module, and the duct, and a storage device, the method comprising:

controlling the storage device to store, whenever a drying operation is performed, output data from the plurality of temperature sensors and opening degree data of the electronic expansion valve;

identifying a factor to be controlled while the drying operation is performed, from among a plurality of factors that may cause incomplete drying, by comparing at least one of the output data from the plurality of temperature sensors and the opening degree data of an electronic expansion valve with the stored data; and controlling the user interface to output a notification of the identified factor to be controlled, wherein the plurality of factors that may cause incomplete drying include clogging of the duct, a failure of a cooling device cooling the power module, and a refrigerant insufficiency of the heat pump.

11. The method of claim 10, wherein the identifying of the factor to be controlled includes identifying the factor to be controlled in a case in which an operation time of a drying operation becomes longer by a preset time or longer than an expected time.

12. The method of claim 10, wherein the identifying of the factor to be controlled includes identifying clogging of the duct as the factor to be controlled in a case in which a number of times by which at least one of temperature of the duct and temperature of a compressor of the heat pump deviates from a corresponding preset temperature range increases in comparison with the stored output data from the plurality of temperature sensors.

13. The method of claim 10, the dryer further including a cooling device to cool the power module, wherein the identifying of the factor to be controlled includes identifying a failure of the cooling device as the factor to be controlled in a case in which a number of times by which temperature of the power module deviates from a preset temperature range increases in comparison with the stored output data from the plurality of temperature sensors.

* * * * *